US005583600A

United States Patent [19]

Kurosawa et al.

[11] Patent Number: 5,583,600

[45] Date of Patent: Dec. 10, 1996

[54] PHOTOSENSITIVE MATERIAL PROCESSING APPARATUS

[75] Inventors: Mitsuhiro Kurosawa; Masayuki Kurematsu; Takehiro Itoga; Hiroyuki Hashimoto; Mina Sato, all of Tokyo, Japan

[73] Assignee: Konica Corporation, Japan

[21] Appl. No.: 450,077

[22] Filed: May 25, 1995

[30] Foreign Application Priority Data

| | | | |
|---|---|---|---|
| May 31, 1994 | [JP] | Japan | 6-118750 |
| Jul. 28, 1994 | [JP] | Japan | 6-177005 |
| Feb. 28, 1995 | [JP] | Japan | 7-040052 |

[51] Int. Cl.[6] ..... G03D 3/08

[52] U.S. Cl. ..... 396/622; 396/641

[58] Field of Search ..... 354/317–324, 354/337–339; 355/72; 428/451; 34/60; 226/188, 189, 190, 108

[56] References Cited

U.S. PATENT DOCUMENTS

| | | | |
|---|---|---|---|
| 3,852,789 | 12/1979 | Russell et al. | 354/339 |
| 4,099,194 | 7/1978 | Kümmerl | 354/321 |
| 4,181,421 | 1/1980 | Kitrosser | 354/321 |
| 4,371,250 | 2/1983 | Wakabayashi et al. | 354/325 |
| 4,384,783 | 5/1983 | Sakata et al. | 355/287 |
| 4,842,944 | 6/1989 | Kuge et al. | 428/451 |
| 4,891,659 | 1/1990 | Kubo et al. | 354/317 |
| 5,074,102 | 12/1991 | Simpson et al. | 53/454 |
| 5,079,853 | 1/1992 | Kurokawa | 34/60 |
| 5,246,111 | 9/1993 | Shibazaki et al. | 355/72 X |

*Primary Examiner*—D. Rutledge

*Attorney, Agent, or Firm*—Jordan B. Bierman; Bierman and Muserlian

[57] ABSTRACT

A photosensitive material processing machine for processing a photosensitive material with a processing solution. The machine includes: a processing rack for forming a conveyance path of the photosensitive material in the processing solution; a conveyance roller, which is disposed in the processing rack, for conveying the photosensitive material; a sheet-shaped guide member for slidablly supporting the photosensitive material, in which the guide member is disposed in the processing rack so that the surface faces to the circumferential surface of the conveyance roller; a guide support member, which is disposed at the upper portion or the bottom portion of the processing rack, for supporting the guide member; and a driving means for driving the conveyance roller. In such the machine, the photosensitive material is conveyed by the conveyance roller as the photosensitive material being nipped between the conveyance roller and the guide member.

37 Claims, 27 Drawing Sheets

FIG. 43A
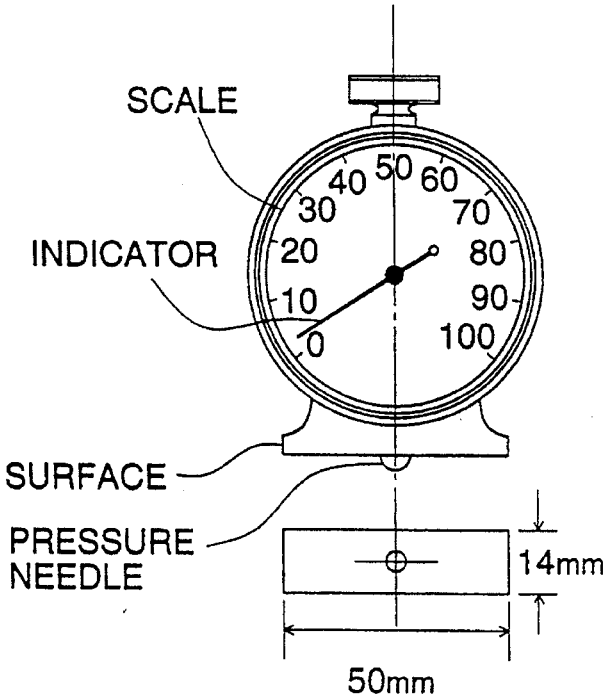
FIG. 43B
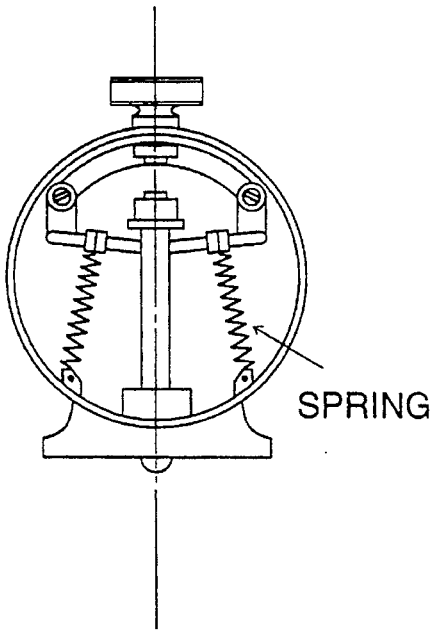
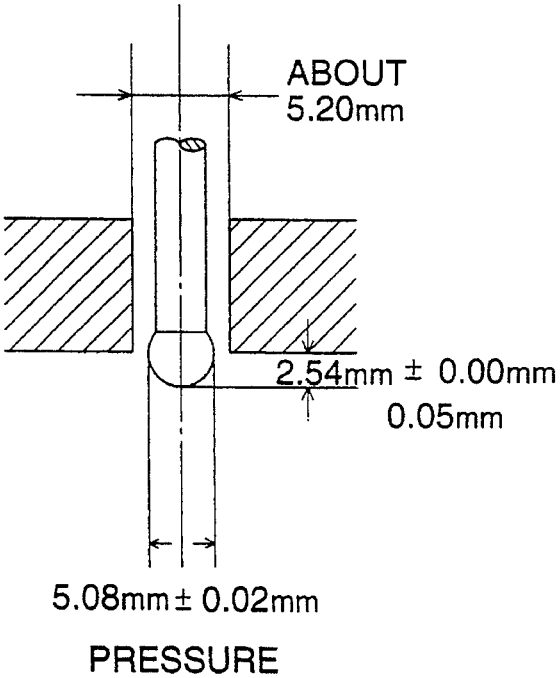
FIG. 43C

PHOTOSENSITIVE MATERIAL PROCESSING APPARATUS

BACKGROUND OF THE INVENTION

The present invention relates to a conveyance roller of a photosensitive material processing apparatus. Also, the present invention relates to a photosensitive material processing apparatus in which the conveyance roller is used.

Concerning the structure of the photosensitive material conveyance means, a conveyance system in which a pair of rollers come into pressure contact with each other is mainly used. According to this system, in order to provide a conveyance force at one position, it is necessary to arrange a pair of rollers, that is, it is necessary to arrange two rollers. When sheets of photographic paper are conveyed, for example, sheets of color photographic paper are conveyed, it is necessary to provide pairs of conveyance rollers, the intervals of which are not more than the minimum sheet width. In this case, a large number of relatively expensive conveyance rollers are used, so that the costs are raised. Since a space corresponding to two pairs of rollers are required for one rack, the dimensions of the apparatus are increased.

Recently, in an automatic developing apparatus, which is an apparatus for processing photosensitive material, the processing time required for developing, bleaching, fixing and stabilizing is remarkably shortened. Accordingly, length of the rack in each processing tank is reduced. Further, technique of processing photosensitive material without washing has made rapid progress in recent years. Due to the foregoing, the automatic developing apparatus is made to be more compact and the prices is further reduced. For this reason, in a mini-laboratory for processing color photosensitive material in a retail shop, there is a strong demand for reduction of the size of the automatic developing apparatus so that the automatic developing apparatus can be installed in a small space, and also there is a strong demand for reduction of the cost.

The present invention has been accomplished to solve the above problems. The first object of the present invention is to provide a compact photosensitive material processing apparatus having a simple photosensitive material conveyance structure capable of processing photosensitive material of high quality at low cost without deteriorating the ability and performance of processing photosensitive material.

Conventionally, a hard resin roller, the core member of which is composed of a stainless steel pipe and covered with a layer of hard resin such as hard vinyl chloride or phenol resin, is used for a conveyance roller arranged in the processing solution tank of a photosensitive material processing apparatus. Also, a rubber roller, the core member of which is composed of a stainless steel pipe and covered with a layer of silicon rubber or ethylene-propylene rubber, is used for the conveyance roller. The reason is that the costs of the above rollers are low and the chemical resistance is high.

As the processing speed of photosensitive material has been increased recently, it is desired to increase the conveyance speed of photosensitive material in the processing tank. However, when the conveyance speed of photosensitive material is increased, the conveyance rollers described above are disadvantageous in that slippage of photosensitive material tends to occur and further the photosensitive material skews while it is conveyed. Therefore, it is difficult to provide a stable conveyance performance.

A method to solve the above problems at low cost is disclosed in Japanese Utility Model Publication Open to Public Inspection No. 44640/1992, in which fine particles are diffused in the material of a plastic roller, and the material is subjected to extrusion so that the outer circumferential surface of the roller can be made to be rough.

Even when the above improved roller is used, it is impossible to avoid the slippage and skew of photosensitive material in the processing solution tank in the process of high speed conveyance of photosensitive material, and it is difficult to convey the photosensitive material at high speed under a stable condition.

However, the above system has several disadvantages which will be described below: When the photosensitive material is conveyed, the sheet of photosensitive material is pressed by the rotating conveyance roller. Therefore, end portions of the sheet of photosensitive material are also stained in such a manner that the end portions of photosensitive material are stained with the solution, and the formed image becomes uneven.

The present invention has been accomplished to solve the above problems. The second object of the present invention is to provide a conveyance roller by which the occurrence of slippage and skew of photosensitive material can be prevented even when the photosensitive material is conveyed at high speed in a photosensitive material processing tank.

In this photosensitive processing apparatus, even when a sheet of photosensitive material is pressed by the conveyance rollers, end portions of the sheet are prevented from contamination.

SUMMARY OF THE INVENTION

The first object of the present invention is accomplished by one of the following technical means (1) to (10).

(1) The present invention is to provide a photosensitive material processing apparatus comprising a processing rack on which a guide member and a conveyance roller are arranged being opposed to each other, the rack being arranged in a processing solution in a processing tank, wherein photosensitive material is conveyed coming into pressure contact with the guide member and conveyance roller, and an engaging means for engaging the guide member is arranged in an upper and/or a lower portion of the processing rack.

(2) The present invention is to provide a photosensitive material processing apparatus comprising a processing rack on which a guide member and a conveyance roller are arranged being opposed to each other, the rack being arranged in a processing solution in a processing tank, wherein photosensitive material is conveyed coming into pressure contact with the guide member and conveyance roller, and the width of the guide member is larger than that of the conveyance roller.

(3) The present invention is to provide a photosensitive material processing apparatus comprising a processing rack on which a guide member and a conveyance roller are arranged being opposed to each other, the rack being arranged in a processing solution in a processing tank, wherein photosensitive material is conveyed coming into pressure contact with the guide member and conveyance roller, and the photosensitive material processing apparatus further comprises a photosensitive material detection sensor attached at an inlet and/or an outlet of the processing tank through which the photosensitive material is conveyed, wherein the movement of the photosensitive material to the processing tank is detected by the photosensitive material detection sensor so that the drive of the conveyance roller is controlled by a detection signal sent from the detection sensor.

(4) The present invention is to provide a photosensitive material processing apparatus comprising a processing rack on which a guide member and a conveyance roller are arranged being opposed to each other, the rack being arranged in a processing solution in a processing tank, wherein photosensitive material is conveyed coming into pressure contact with the guide member and conveyance roller, and the drive of the conveyance roller is controlled by the information sent from a printer in accordance with the movement of the photosensitive material into the processing tank.

(5) The present invention is to provide a photosensitive material processing apparatus comprising a processing rack on which a guide member and a conveyance roller are arranged being opposed to each other, the rack being arranged in a processing solution in a processing tank, wherein photosensitive material is conveyed coming into pressure contact with the guide member and conveyance roller, and a recess is formed in a portion of the guide member opposed to the conveyance roller over the width of the conveyance roller, and or a clearance of 0.1 to 2 mm is provided between the guide member and the conveyance roller.

(6) The present invention is to provide a photosensitive material processing apparatus comprising a processing rack on which a guide member and a conveyance roller are arranged being opposed to each other, the rack being arranged in a processing solution in a processing tank, wherein photosensitive material is conveyed coming into pressure contact with the guide member and conveyance roller, and the guide member is like a sheet, the thickness of which is 0.1 to 3 mm.

(7) The present invention is to provide a photosensitive material processing apparatus comprising a processing rack on which a guide member and a conveyance roller are arranged being opposed to each other, the rack being arranged in a processing solution in a processing tank, wherein photosensitive material is conveyed coming into pressure contact with the guide member and conveyance roller, and an opening is formed on a side plate of the processing rack and/or the guide member.

(8) The present invention is to provide a photosensitive material processing apparatus comprising a processing rack on which a guide member and a conveyance roller are arranged being opposed to each other, the rack being arranged in a processing solution in a processing tank, wherein photosensitive material is conveyed coming into pressure contact with the guide member and conveyance roller, and the photosensitive material processing apparatus further comprises nozzles for circulating a processing solution zigzag in a direction perpendicular to the photosensitive material conveyance direction.

(9) The present invention is to provide a photosensitive material processing apparatus comprising a processing rack on which a guide member and a conveyance roller are arranged being opposed to each other, the rack being arranged in a processing solution in a processing tank, wherein photosensitive material is conveyed coming into pressure contact with the guide member and conveyance roller, and the photosensitive material processing apparatus further comprises a pushing member for pushing the guide member toward the conveyance roller, and one processing rack is formed when an inner frame having the conveyance roller and an outer frame having the guide member and the pushing member are detachably joined.

(10) The present invention is to provide a photosensitive material processing apparatus comprising a processing rack on which a guide member and a conveyance roller are arranged being opposed to each other, the rack being arranged in a processing solution in a processing tank, wherein photosensitive material is conveyed coming into pressure contact with the guide member and conveyance roller, and the photosensitive material processing apparatus further comprises a pushing member for pushing the guide member toward the conveyance roller, and one processing rack is formed when an inner frame having the conveyance roller and the guide member and an outer frame having the pushing member are detachably joined.

The second object of the present invention described above can be accomplished by one of the following technical means (11) to (29).

(11) A conveyance roller used in a processing solution tank of a photosensitive material processing apparatus, at least the outer circumferential surface of which is made of a porous resin or a porous rubber, wherein the porous resin or the porous rubber is made of fiber materials subjected to thermal fusion, or alternatively the porous plastic is made of a sintered material.

(12) The conveyance roller used for a photosensitive material processing apparatus according to item (11), wherein a center portion of the conveyance roller is composed of a barrel roller or a cylindrical roller, and the conveyance roller has a multi-layer structure in which the outer circumferential surface is made of the porous resin or the porous rubber.

(13) The conveyance roller used for a photosensitive material processing apparatus according to item (11) or (12), wherein the porous resin or the porous rubber is a plastic resin, selected from polyolefines, polyesters, polyacrylonitriles, aliphatic polyamides, aromatic polyamides, polyphenylene sulfides, polytetrafluoroethylene, polyurethane, silicone, and ethylene-propylene, or alternatively the porous resin or the porous rubber is a composite material comprising at least one of the porous plastic resins.

(14) The conveyance roller used for a photosensitive material processing apparatus according to item (11) or (12), wherein the porous plastic contains a composite material of polyethylene and polypropylene.

(15) The conveyance roller used for a photosensitive material processing apparatus according to one of items (12) to (14), wherein the porous plastic is formed into a cylindrical shape and the barrel roller is press-fitted into it.

(16) The conveyance roller used for a photosensitive material processing apparatus according to one of items (12) to (15), wherein the porous plastic layer is put on the barrel roller and subjected to thermal fusion so as to be solidified.

(17) The conveyance roller used for a photosensitive material processing apparatus according to one of items (11) to (16), wherein the conveyance roller comes into contact with an emulsion surface of the sheet of photosensitive material in the process of conveyance.

(18) The conveyance roller used for a photosensitive material processing apparatus according to one of items (11) to (17), wherein the conveyance roller is arranged being opposed to a guide member in the processing solution in the processing solution tank, and a sheet of photosensitive material is conveyed being pressed by the guide member and the conveyance roller.

(19) A photosensitive material processing apparatus comprising a conveyance roller arranged in the processing tank, the outer circumferential surface of the conveyance roller being made of a porous plastic, wherein the porous plastics is made when plastic fibers are subjected to thermal fusion, or the porous plastics is made of sintered plastics.

(20) A conveyance roller and guide member are arranged in the processing solution in the processing solution tank of a photosensitive material processing apparatus while the conveyance roller and guide member are opposed to each other. In the photosensitive material processing apparatus, a photosensitive material sheet is conveyed being pressed between the conveyance roller and guide member. An outermost layer on the conveyance roller of the photosensitive material processing apparatus is made of material, the hardness of which is not more than 60 defined by the SRIS 0101 standard of Japan Rubber Institution.

(21) A conveyance roller described in item (20), wherein a barrel composing roller is provided at a center of the conveyance roller, and at least one outermost layer is provided on the outside of the barrel composing roller.

(22) A conveyance roller described in item (21), wherein the barrel composing roller is made of a material selected from polyolefines, polyphenylene sulfide, denatured polyphenylene oxide (denatured polyphenylene ether), phenol resin, vinyl chloride, stainless steel, and titanium.

(23) A conveyance roller described in one of the items (20) to (22), wherein the outermost layer on the conveyance roller is composed of fabric or non-woven fabric made of a material, selected from polyolefine fibers, polyester fibers, polyacrylonitrile fibers, aliphatic polyamide fibers, aromatic polyamide fibers, and polyphenylene sulfide fiber.

(24) A conveyance roller described in one of the items (20) to (23), wherein the outermost circumferential layer on the conveyance roller is made of the mollten.

(25) A conveyance roller described in item (24), wherein the aforementioned mollten is polypropylene.

(26) A conveyance roller described in item (24), wherein an end portion of the aforementioned mollten is processed by means of thermal fusion.

(27) A conveyance roller described in item (24), wherein a fabric loop formation surface of the aforementioned mollten is arranged to be fixed to the outer surface on the barrel composing roller.

(28) A conveyance roller described in one of the items (20) to (27), wherein the conveyance roller conveys a photosensitive material sheet while the conveyance roller comes into contact with an emulsion surface of the photosensitive material sheet.

(29) A photosensitive material processing apparatus comprising a conveyance roller arranged in a processing tank, the hardness of the outermost circumferential layer of the conveyance roller being not more than 60 defined by the SRIS Standard 0101 of Japanese Rubber Institution, wherein the conveyance roller and the guide member are arranged in the processing solution in the processing tank being opposed to each other, and a photosensitive material sheet is conveyed being pressed between the guide member and the conveyance roller.

BRIEF DESCRIPTION OF THE DRAWINGS

FIG. 43A, 43B and 43C are schematic illustrations showing a test made in accordance with Asker C.

DETAILED DESCRIPTION OF THE INVENTION

With reference to the accompanying drawings, examples of the photosensitive material processing apparatus of the present invention will be explained below.

First, referring to FIG. 1 which is a side view showing an overall arrangement of the photosensitive material processing apparatus of the present invention, the entire apparatus will be explained as follows.

Figure 1:
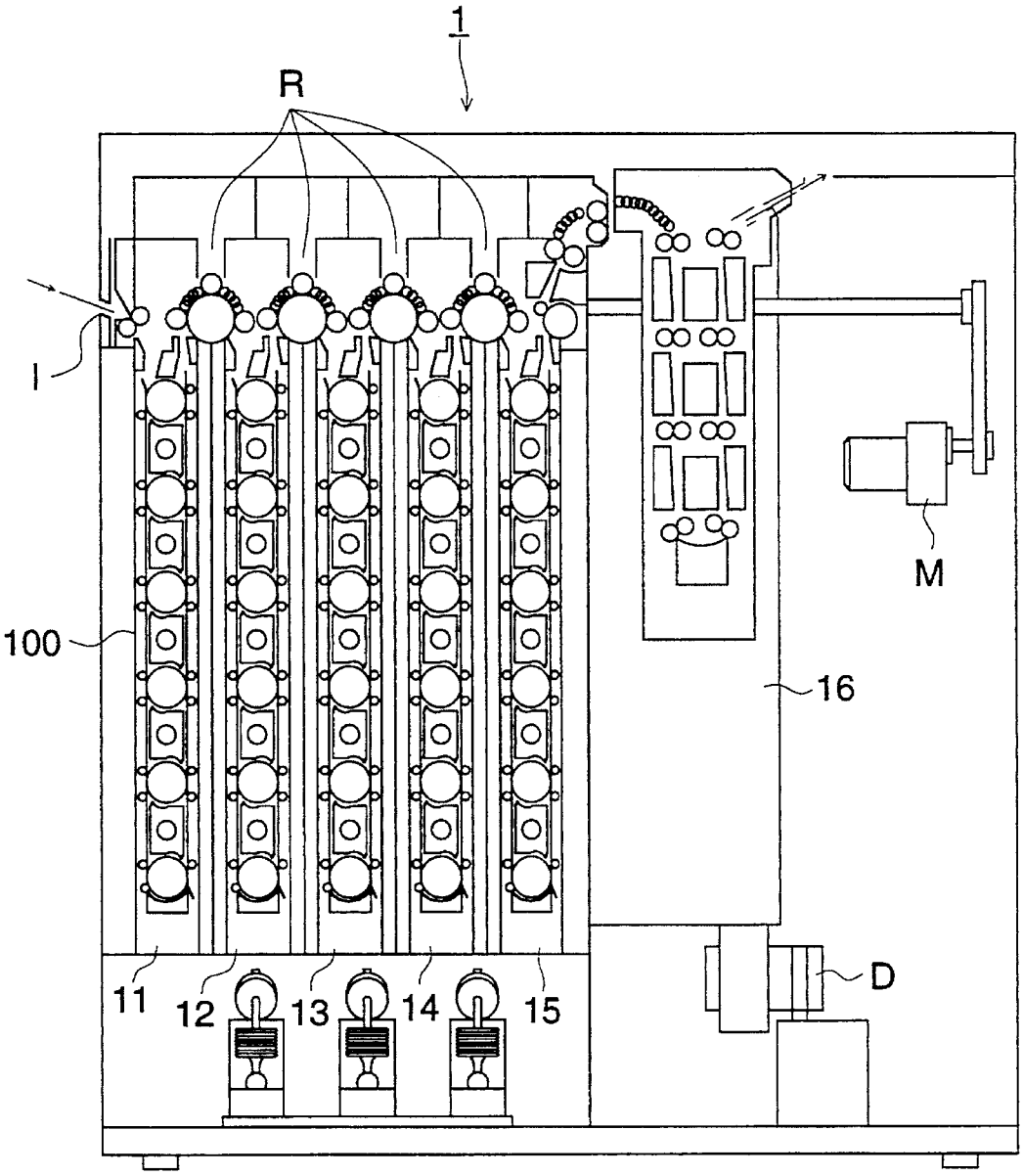
FIG. 1 is a side view showing an overall arrangement of the photosensitive material processing apparatus of the present invention.

As illustrated in FIG. 1, the photosensitive material processing apparatus 1 is provided with processing tanks which are partitioned off as shown in the drawing. Numeral 11 is a CD tank for color development, numeral 12 is a BF tank for bleaching and fixing, numeral 13 is an STB-1 tank for the first stabilization processing, numeral 14 is an STB-2 tank for the second stabilization processing, numeral 15 is an STB-3 tank for the third stabilization processing, and numeral 16 is a drying section for drying the photosensitive material in which development processing has been completed. In the photosensitive material processing apparatus 1, the photosensitive material is conveyed in the arrowed direction and passes through each processing rack 100 arranged in each processing tank. Then the photosensitive material is conveyed out from the interconnection rack R and subjected to development processing. After that, the photosensitive material is dried in the drying section and conveyed in the arrowed direction.

The processing rack 100 arranged in each processing tank and the drying section 16 are driven by motor M. In the drying section 16, a current of air is generated by a heater and fan D which are built in the drying section 16. The photosensitive material is dried by current of hot air.

The photosensitive material processing apparatus of the present invention is effectively used for a sheet of photosensitive material, however, it is also effectively used for a roll of photosensitive material. It is possible to provide desirable effects when the apparatus of the present invention is applied to not only color photographic paper but also monochromatic paper or reversal photographic paper.

Figure 2:
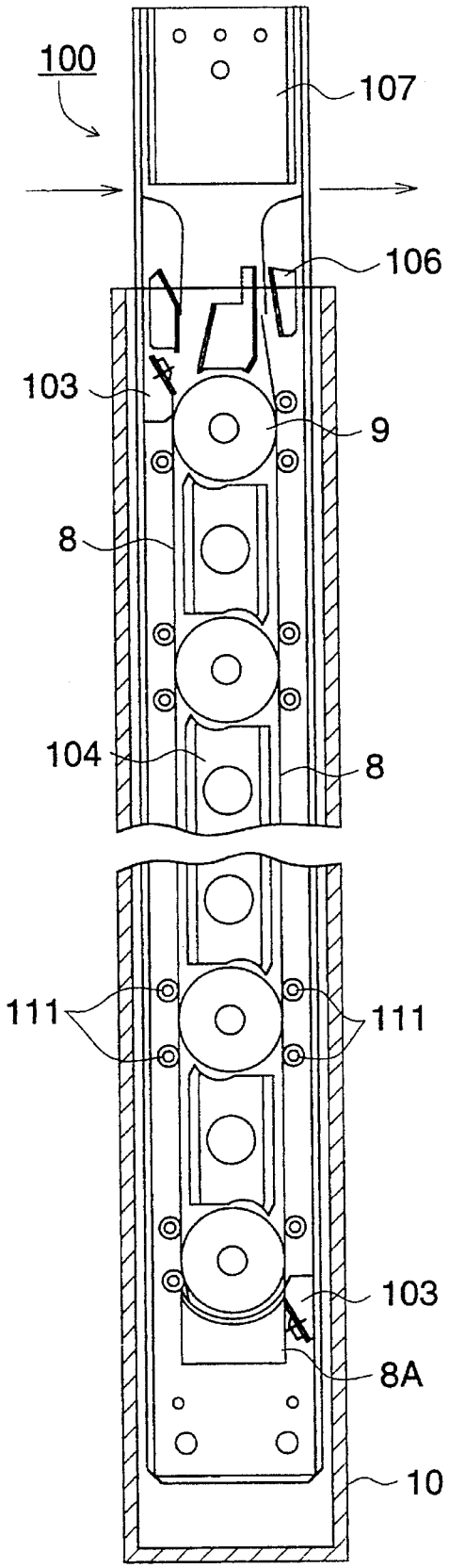
FIG. 2 is a view showing the fundamental arrangement of the processing rack of the photosensitive material processing apparatus of the present invention.

FIG. 2 is a view showing an essential arrangement of the processing rack of the photosensitive material processing apparatus of the present invention, wherein a central portion of the processing rack is omitted in the drawing. The processing rack 100 includes: conveyance rollers 9, sheet-shaped guide members 8 arranged on both sides of the conveyance rollers 9, guide support members 103, guides 104, a U-shaped turn guide 8A arranged at a lower position, an upper guide 106, processing rack side plates 107, and holding members 111.

In FIG. 2, the guide member 8 is arranged on the left of the conveyance rollers 9. In this case, an upper end of the guide member 8 is supported by the guide support member 103, and a lower end is attached to the lower turn guide 8A in such a manner that the end portion is inserted into the lower turn guide 8A. Another guide member 8 is arranged on the right of the conveyance rollers 9. In this case, a lower end of the guide member 8 is attached to the guide support member 103, and an upper end is attached to the upper guide 106 in such a manner that the upper end is inserted into the upper guide 106.

At a position where the guide member 8 is opposed to the conveyance roller 9, the conveyance roller 9 is held from both sides by the guide member 8 through one or two holding members 111. The photosensitive material is interposed between the guide member 8 and the conveyance roller 9. When the guide member 8 and the conveyance roller 9 come into pressure contact with each other, the photosensitive material is conveyed. In the case where they are not contacted with each other, the clearance is maintained to be 0 to 5 mm. The photosensitive material is guided by the guide 104 arranged between the conveyance roller 9.

In a lower portion of the processing rack 100, the photosensitive material is guided by the lower turn guide 8A. In this way, the photosensitive material conveyed into the processing rack 100 in the arrowed direction is sent out from the processing rack 100 in the arrowed direction. In the case where a sheet of photosensitive material is processed, it is necessary that intervals of the conveyance rollers 9 are shorter the minimum size of the sheet. For example, in the case of sheets of color photographic paper, the intervals of the conveyance rollers 9 are set to be shorter than the E (economy) size.

The essential structure and mode of operation of the photosensitive material of the present invention are described above.

Figure 3:
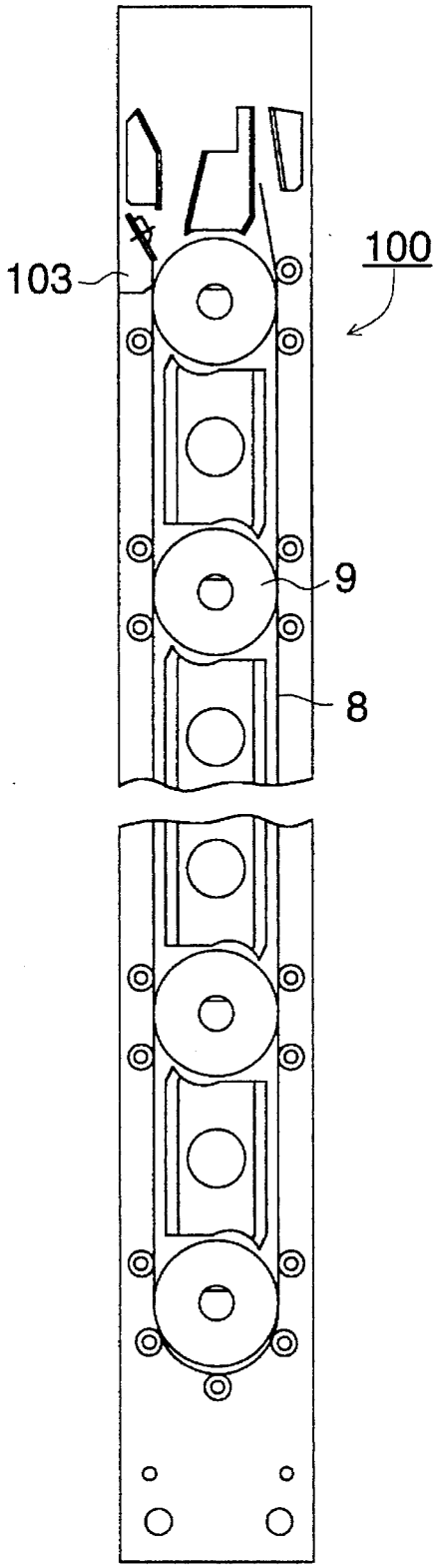
FIGS. 3(A) and 3(B) are views showing another processing rack of the photosensitive material processing apparatus of the present invention.
Figure 3:
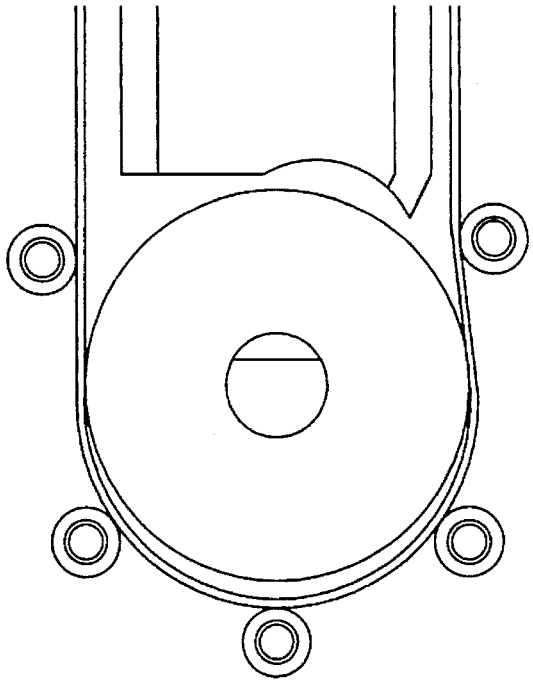

The processing rack 100 shown in FIGS. 3(A) and 3(B) is different from that shown in FIG. 2. The guide support member 103 for supporting the guide member 8 is arranged only in the upper portion of the processing rack 100. In FIG. 3(A), an intermediate portion of the processing rack 100 is omitted, and FIG. 3(B) is an enlarged view of the lower portion of the processing rack 100. In the processing rack shown in FIG. 2, the conveyance passage of the photosensitive material is divided into the first and the second half, and the guide member 8 is supported by the upper support member 103 of the processing rack 100, and the guide member 8 is also supported by the lower support member 103 of the processing rack 100. On the other hand, in the processing rack 100 shown in FIG. 3, there is provided a sheet-shaped guide member which continues from the first to the second half, and only the upper portion is supported by the guide support member 103. Due to the foregoing structure, it is not necessary to provide the lower turn guide 105, so that the structure can be made to be simple, which reduces the cost of the processing rack. Further, a leading end of the photosensitive material does not collide with the lower turn guide 8A when it is sent from the guide member 8. Accordingly, the photosensitive material can be stably conveyed when it turns at the lower portion of the processing rack.

Figure 4:
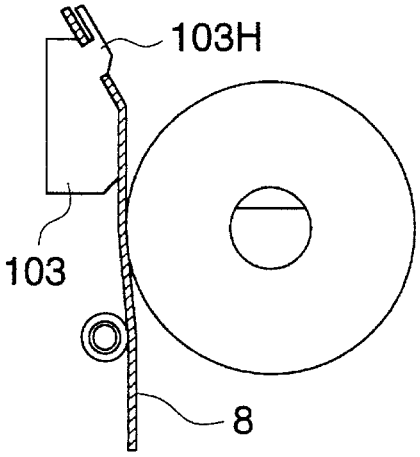
FIGS. 4(A) and 4(B) are views showing the details of the processing rack of the photosensitive material processing apparatus of the present invention.
Figure 4:
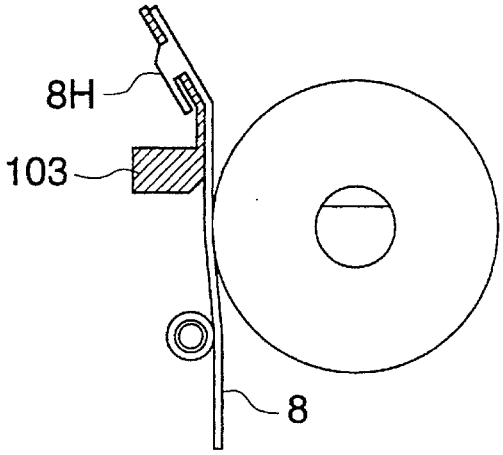

FIGS. 4(A) and 4(B) are views showing the detail of the upper guide support member 103 of the processing rack 100. FIG. 4(A) shows a structure in which a hook 103H is provided in the guide support member 103, and a hole formed at a fore end of the guide member 8 is caught at hook 103H. This structure is preferably used. FIG. 4(B) shows a structure in which a hook 8H is provided at a fore end of the guide member 8, and the hook 8H is caught in a hole provided in the guide support member 103. This structure is also preferably used.

In any cases, when the guide support member 103 for supporting the guide member 8 is provided in the upper and/or lower portion the processing rack 100, the guide member 8 is attached to the processing rack 100 only by one or two portions. Therefore, assembly and maintenance can be improved.

FIGS. 5(A) and 5(B) are views showing the rotational direction of the conveyance roller 9 and also showing a condition in which the guide member 8 is supported by the guide member 103. FIG. 5(A) is a view showing a condition in which the conveyance roller is rotated counterclockwise, that is, the photosensitive material is processed. FIG. 5(B) is a view showing a condition in which the conveyance roller is rotated clockwise, that is, the conveyance roller 9 is reversed with respect to the rotation of processing the photosensitive material.

FIG. 5(A) shows a condition in which the conveyance roller 9 is rotated counterclockwise in the processing of photosensitive material and the guide member 8 is engaged with the support member 103. FIG. 5(B) shows a condition in which the conveyance roller 9 is rotated clockwise as described above and the guide member 8 is released from the support member 103 so that the guide member 8 can be released from the processing rack.

As illustrated in FIGS. 5(A) and 5(B), when an end of the hook 103H of the guide support member 103 is directed upward so that it can be engaged in one direction, the guide member 8 is engaged with the guide support member 103 by the action of the conveyance roller 9 coming into frictional contact with the guide member 8 during the processing of photosensitive material (during the counterclockwise rotation), so that the engagement can be ensured. When the conveyance roller 9 is reversed, that is, when the conveyance roller 9 is rotated clockwise, the guide member 8 is released from the guide support member 103 by the frictional force caused between the guide member 8 and the conveyance roller 9. Therefore, it is possible to remove the guide member 8 from the processing rack. The guide member 8 is made of flexible material, for example, resin sheet of thin metal.

It is possible to assemble the guide member 8 to the apparatus when the conveyance roller 9 is rotated counterclockwise. In order to prevent the guide member 8 from protruding outside from the processing rack 100 when the guide member 8 is assembled to the apparatus, it is preferable that a guide portion 111G is attached to the holding guide member 111.

Accordingly, by the action of the guide support member 103 and the rotation of the conveyance roller 9, the guide member 8 can be easily attached to and detached from the processing rack 100.

When the end of the hook 103H of the guide support member 103 is directed upward so that the end of the hook 103H can be engaged in one direction and when the conveyance roller 9 is rotated in the conveyance direction of photosensitive material, the guide member 8 is engaged with the guide support member 103, which is the engaging means, in one direction. When the conveyance roller 9 is rotated in a direction opposite to the conveyance direction of photosensitive material, it is possible to release the guide member 8 from the guide support member 103, and it is also possible to remove the guide member 8 from the processing rack.

As described above, it is possible to attach the guide member 8 to the processing rack 100 and it is also possible to detach the guide member 8 from the processing rack 100 without removing the processing rack 100 form the processing tank. Accordingly, it is possible to replace the guide member 8 easily, and the properties of assembly and maintenance can be enhanced.

Figure 6:
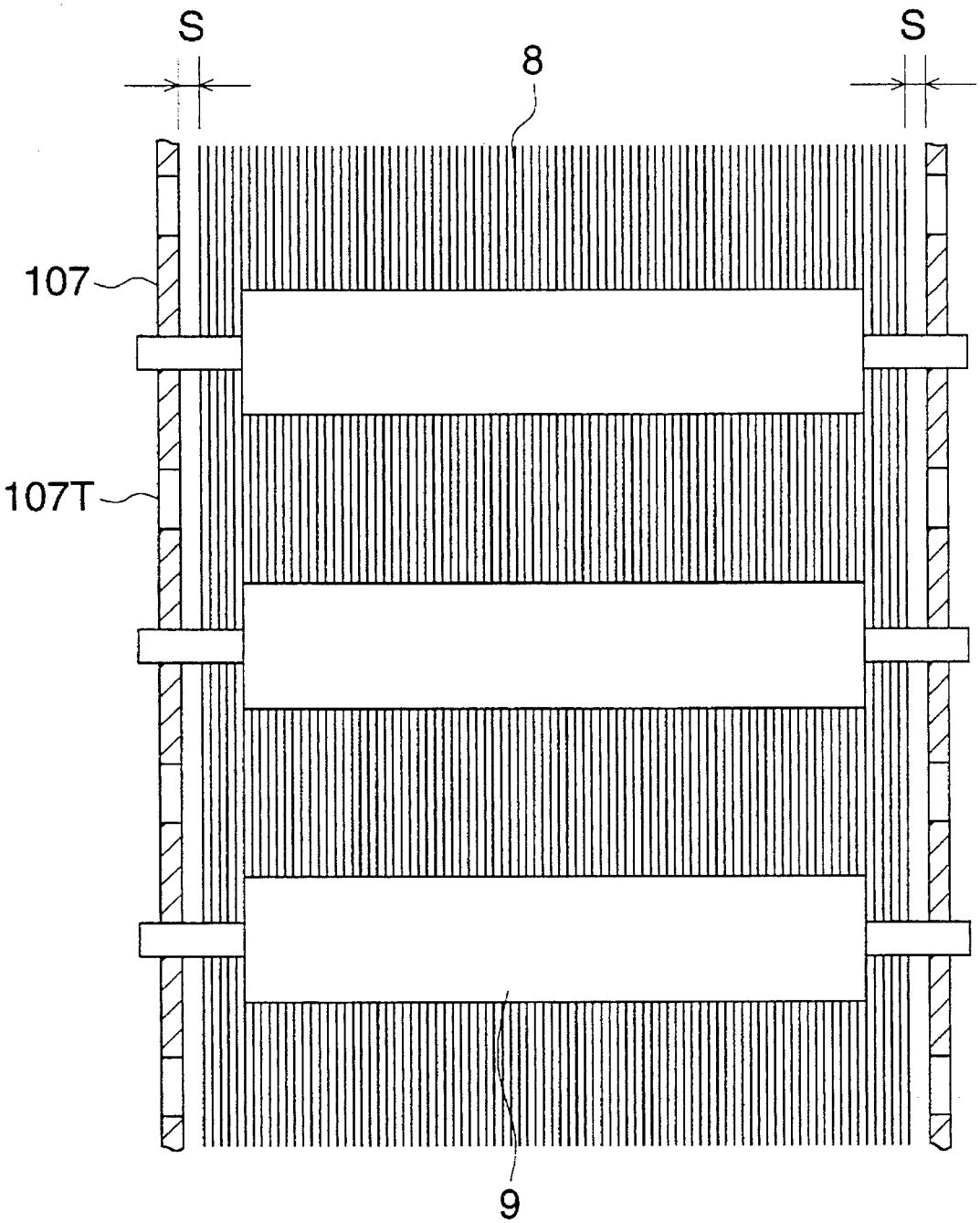
FIG. 6 is a view showing the wide guide member of the photosensitive material processing apparatus of the present invention.

FIG. 6 is a view showing a guide member 8, the width of which is wider than that of the conveyance roller 9. In this case, it is preferable that a clearance "s" formed between the guide member 8 and the processing rack side plate 107 is small, however, in order to allow the processing solution to flow smoothly, it is necessary to provide openings 107T on the processing rack side plate 107.

When the width of the guide member 8 is wider than that of the conveyance roller 9, a splash of the solution caused by an end of the conveyance roller 9 can be reduced in the removal of the processing rack 100 from the processing tank. Therefore, it is effective to prevent the contamination of the solution in other processing tanks.

When the guide member 8 is water-repellent and the processing rack 100 is subjected to the treatment of water-repellency, the solution can be repelled from the member when the processing rack 100 is taken out from the processing tank, so that the water-repelling time can be shortened and the guide member 8 can be easily replaced. In order to provide water-repellency, the member may be made of fluororesin such as PTFE, or alternatively the surface of the member may be coated with fluororesin.

Figure 7:
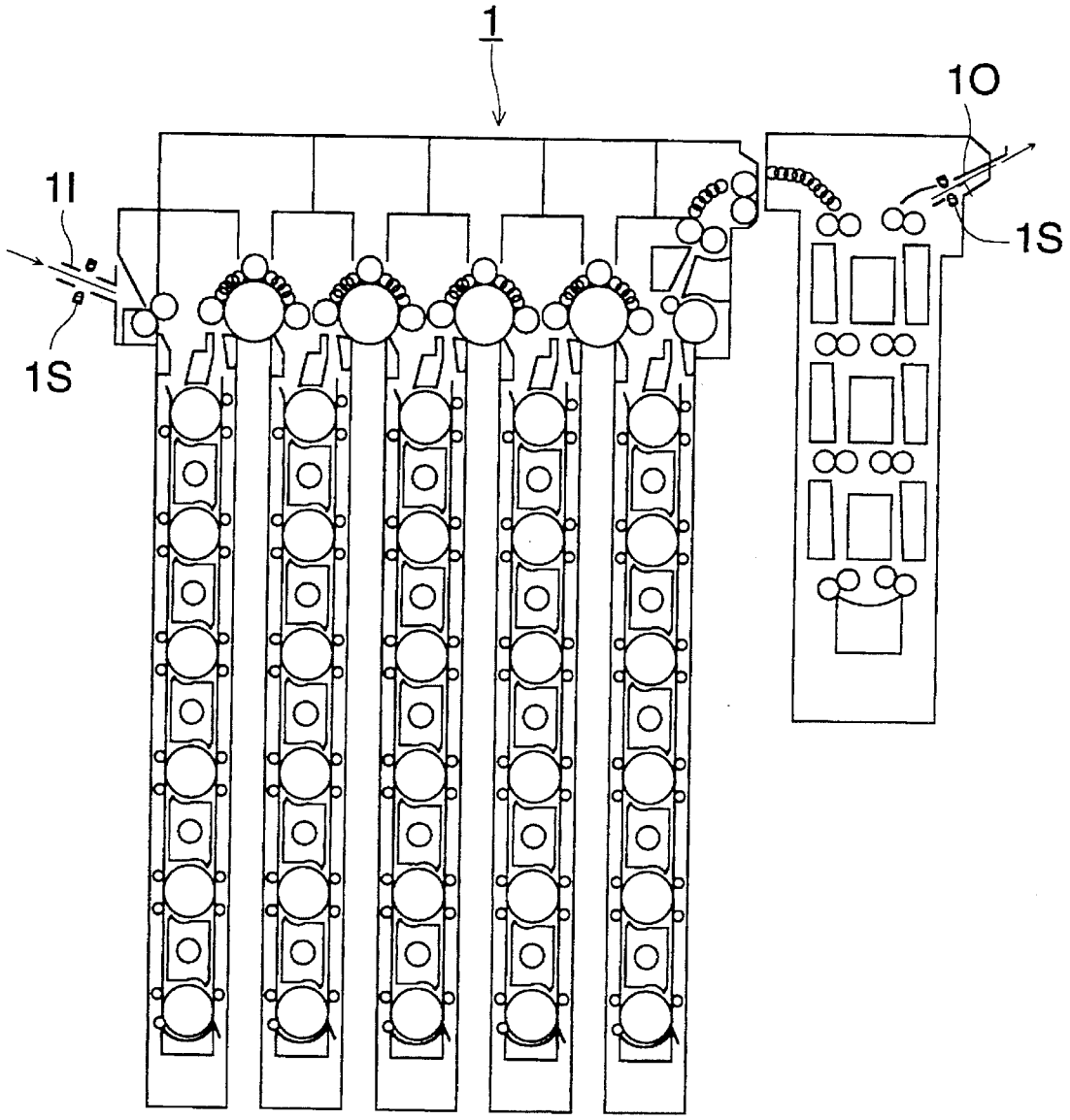
FIG. 7 is an arrangement view of the photosensitive material detection sensor of the photosensitive material processing apparatus of the present invention.

In the photosensitive material processing apparatus 1 illustrated in FIG. 7, photosensitive material detection sensors 1S are arranged at the photosensitive material inlet 1I and outlet 10. The photosensitive material detection sensors is may be located at any positions outside the processing tank, however, it is preferable that the photosensitive material detection sensors 1S are located at the inlet 1I where the photosensitive material is in a dry condition, and at the outlet 10 of the drying section. When the photosensitive material detection sensors 1S detect the photosensitive material, the conveyance rollers 9 of the processing rack 100 are controlled in the photosensitive material processing apparatus 1. When the drive of the conveyance rollers 9 is controlled while consideration is given to the processing time of photosensitive material, the detection sensor 1S may be provided only at the inlet 1I.

As described above, the photosensitive material detection sensors 1S are arranged at the inlet 1I and the outlet 10 of the processing tank, and movement of the photosensitive material is detected by the detection sensors 1S so as to control the drive of the conveyance rollers 9. When the operation is carried out in the above manner, friction is not caused between the guide member 8 and the conveyance roller 9, and abrasion of the members can be reduced.

It is preferable that the conveyance speed of photosensitive material is lower than the photosensitive material processing speed when the photosensitive material is not processed. It is more preferable that the conveyance speed is as slow as possible. In the case where a variable speed motor is used for the drive source, it is preferable that the conveyance speed is set to a minimum in an allowable range of torque.

As described above, the conveyance speed of the conveyance roller 9 is controlled in accordance with the movement of photosensitive material effected by the detection signal sent from the photosensitive material detection sensor 1S. Due to the foregoing operation, for example, when the rotational speed of the conveyance roller 9 is reduced when the photosensitive material is not processed, the guide member 8 and the conveyance roller 9 are not deformed at the contact positions. Therefore, abrasion of the guide member 8 and the conveyance roller 9 can be reduced to some extent.

If photosensitive material detection sensors are provided in the printer, it is possible to control the drive of the conveyance rollers 9 of the photosensitive material processing apparatus 1 in accordance with information provided by a detection signal sent from the printer or in accordance with a direction of exposure. That is, the drive of the conveyance roller 9 of the photosensitive material processing apparatus 1 is controlled in accordance with the movement of photosensitive material to the processing tank by information sent from the printer.

Due to the foregoing controlling operation, when the photosensitive material is not processed, abrasion is not caused on the surfaces of the guide member 8 and conveyance roller 9.

It is preferable that the conveyance speed of photosensitive material is lower than the photosensitive material processing speed when the photosensitive material is not processed. It is more preferable that the conveyance speed is as slow as possible. In the case where a variable speed motor is used for the drive source, it is preferable that the conveyance speed is set to a minimum in an allowable range of torque.

As described above, the conveyance speed of the conveyance roller 9 is controlled in accordance with the movement of photosensitive material effected by the information sent from the printer. Due to the foregoing operation, for example, when the rotational speed of the conveyance roller 9 is reduced when the photosensitive material is not processed, the guide member 8 and the conveyance roller 9 are not deformed at the contact positions. Therefore, abrasion of the guide member 8 and the conveyance roller 9 can be reduced to some extent.

Figure 8:
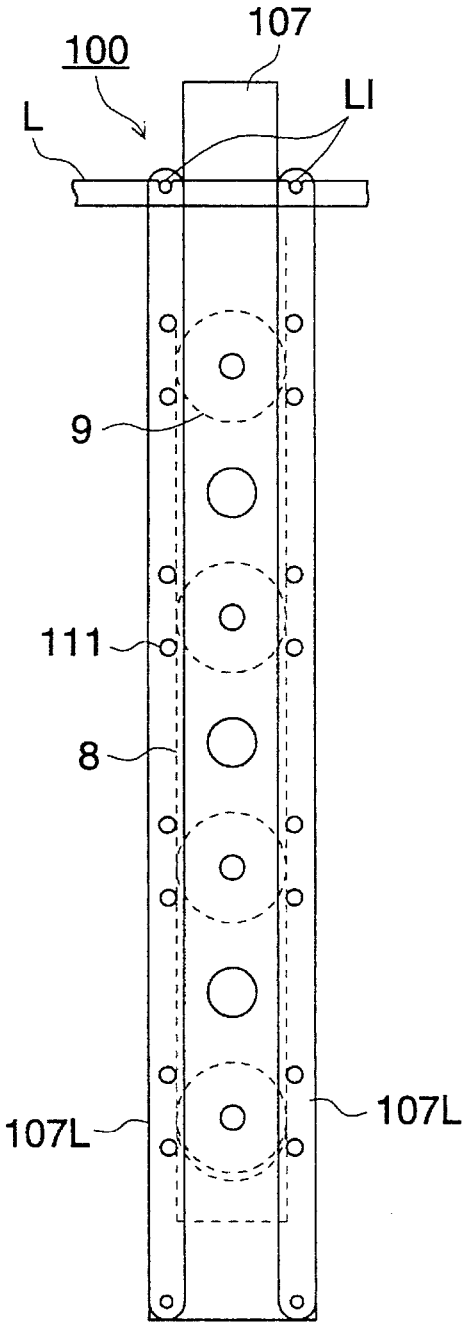
FIGS. 8(A) and 8(B) are views showing the mechanism for releasing the pressure contact of the guide member of the photosensitive material processing apparatus of the present invention.
Figure 8:
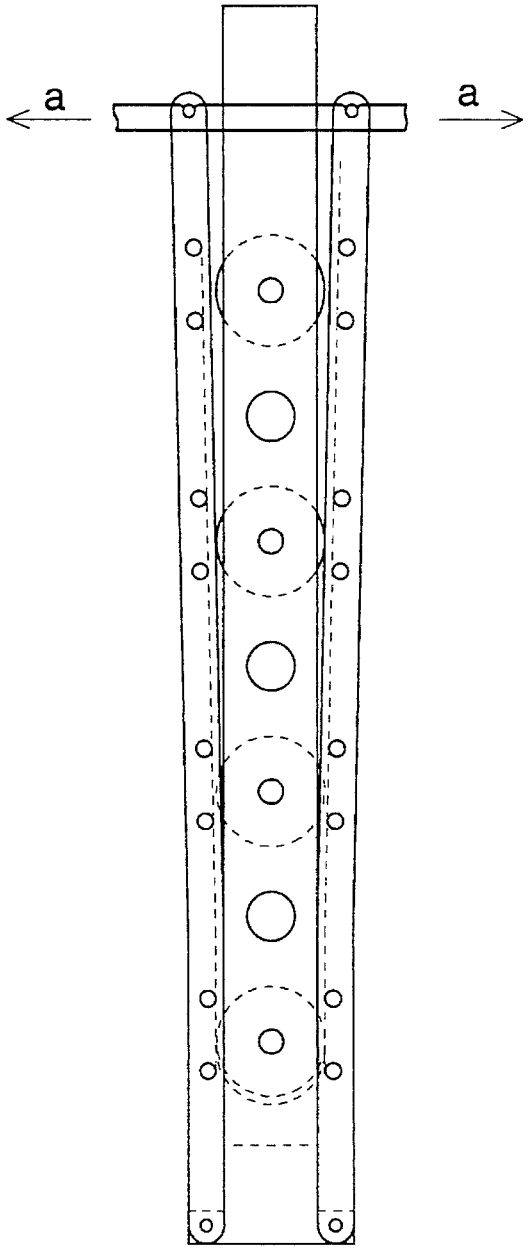

FIGS. 8(A) and 8(B) are views showing one unit of the processing rack 100 provided with a mechanism for releasing the pressure contact between the guide member 8 and the conveyance roller 9. In FIG. 8(A), the guide member 8 comes into pressure contact with the conveyance roller 9. In FIG. 8(B), the guide member 8 is released from the pressure contact with the conveyance roller 9. When a lever 107L supporting the holding members 111 on both sides of the processing rack side plate 107 is open on both sides in the direction of "a", pressure contact of the guide member 8 with the conveyance roller 9 is released as illustrated in FIG. 8(B). A force is transmitted from the link L to the lever 107L when an engaging portion LI of the lever 107L is caught by a recess formed in the link L provided in the photosensitive material processing apparatus 1. In this connection, two pieces of links L are put on each other, and the engaging portion LI of the left lever 107L of the processing rack 100 is caught by the recess of one of the links L, and the engaging portion LI of the right lever 107L is caught by the recess of the other link L. Accordingly, when the two links L are respectively driven to the direction of arrow "a", the pressure contact is released as illustrated in FIG. 8(B). The links L may be driven manually, however, they may be automatically driven by a motor or magnet.

As described above, the release means is provided for releasing the pressure contact of the guide member 8 with the conveyance roller 9. By the release means, the pressure contact of the guide member 8 with the conveyance roller 9 is released while the photosensitive material is not conveyed. Therefore, deformation and abrasion of the conveyance roller 9 can be avoided during the stoppage of the conveyance roller 9.

Figure 9:
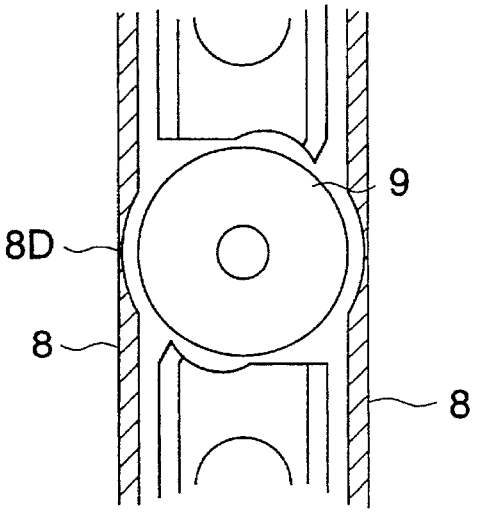
FIGS. 9(A) to 9(C) are views showing a clearance between the guide member and the conveyance roller of the photosensitive material processing apparatus of the present invention.
Figure 9:
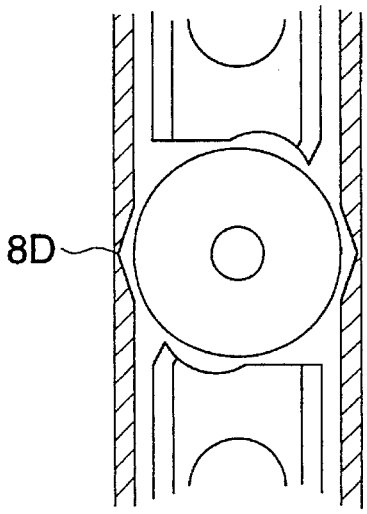
Figure 9:
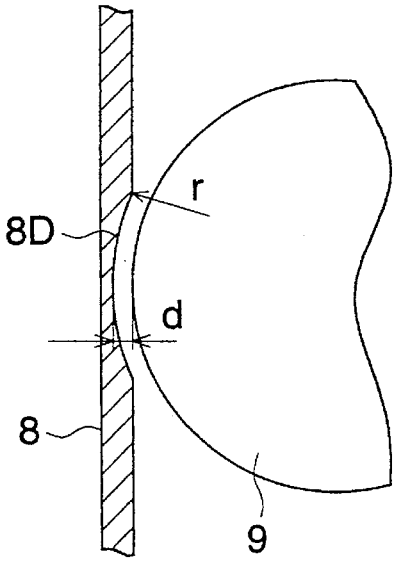

FIGS. 9(A), 9(B) and 9(C) are schematic illustrations for explaining a clearance formed between the conveyance roller 9 and a recess portion of the guide member 8 opposed to the conveyance roller 9. In FIG. 9(A), the recess is formed to be a circular arc. In FIG. 9(B), the recess is formed to be a V-shape. In FIG. 9(C), the recess is formed to be a circular arc. It is preferable to adopt the configuration of the recess shown in FIG. 9(A) which is formed to be a circular arc, the radius of which corresponds to an addition of the radius and clearance of the conveyance roller 9. The V-shaped configuration of the recess shown in FIG. 9(B), which is close to the configuration of the recess shown in FIG. 9(A), is also preferable. It is preferable that an end portion of the recess is located on a tangent of the conveyance roller 9 in the photosensitive material conveyance passage. It is preferable that a corner "r" at the fore end of the recess is chamfered. A clearance "d" between the guide member 8 and the conveyance roller 9 is preferably 0.1 to 2 mm. For example, in the case of a sheet of color photographic paper, it is preferable that the clearance "d" is the same as the thickness of the sheet, that is, the clearance "d" is approximately 0.2

As described above, the recess is provided in the guide member 8 opposed to the conveyance roller 9 in the axis direction of the conveyance roller, and the clearance of 0.1 to 2 mm is provided between the recess and the conveyance roller. Due to the foregoing, the guide member 8 and the conveyance roller 9 are not contacted with each other at all times. Therefore, friction between the guide member 8 and the conveyance roller 9 can be avoided, and the durability can be enhanced and further the drive force can be reduced. Furthermore, the photosensitive material can be conveyed smoothly by its own rigidity.

Figure 10:
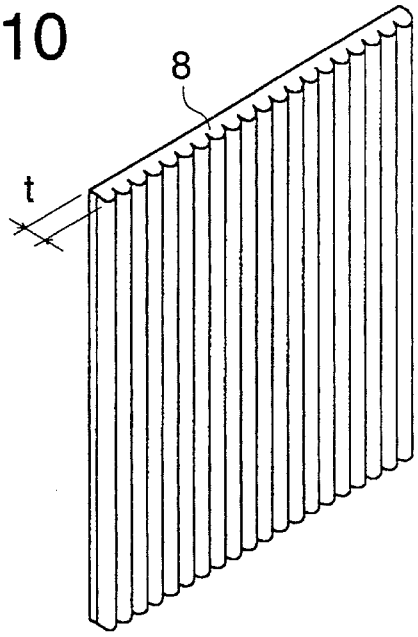
FIG. 10 is a perspective view showing the guide member of the photosensitive material processing apparatus of the present invention.

FIG. 10 is a perspective view showing the guide member 8. It is preferable that the guide member 8 is composed of flexible sheet, the thickness of which is 0.1 to 3 mm.

It is preferable that the guide member 8 is made of soft or elastic material, the Vickers hardness of which is 2 to 10 $kg/cm^2$. For example, in the case of a sheet of color photographic paper, the thickness "t" of the guide member 8 is most preferably 0.5 to 1.5 mm. The surface shape of the guide member 8 is not restricted to the shape shown in FIG. 10. Flat surface of the guide member is allowed to be used. The shape which has grooves (or ribs) in the direction of the conveyance of the photosensitive material, is preferable to avoid stress between guide member 8 and the photosensitive material. And also the groove or ribs help to avoid dislocation of the sheet conveyance.

Figure 11:
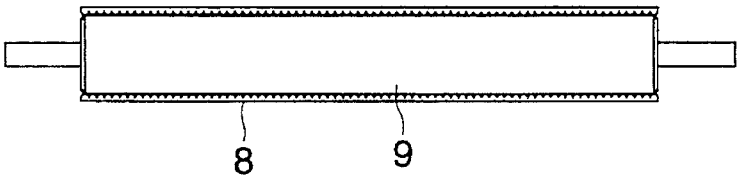
FIGS. 11(A) to 11(C) are views showing the guide member opposed to the conveyance roller of the photosensitive material processing apparatus of the present invention.
Figure 11:
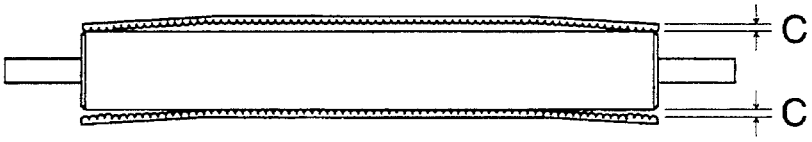
Figure 11:
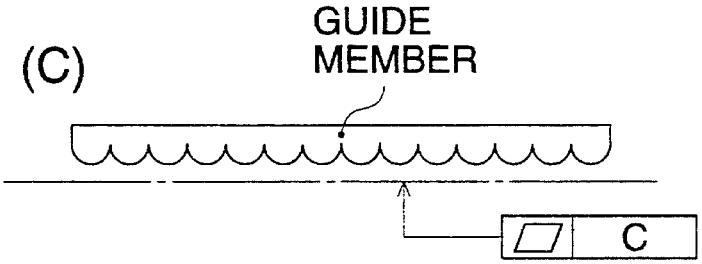

FIGS. 11(A), 11(B) and 11(C) are sectional views of the guide member 8 opposed to the conveyance roller 9. FIG. 11(A) is a view showing a condition in which the flatness of the guide member 8 is 0, and the guide member 8 comes into pressure contact with the conveyance roller 9. FIG. 11(B) is a view showing a condition in which the flatness of the guide member 8 coming into pressure contact with the conveyance roller 9 is not 0 but a clearance C is formed. In this case, it is most preferable that the flatness of a portion of the guide member 8 opposed to the conveyance roller 9 is 0. However, when the flatness is not more than 1 mm, and preferably when the flatness is not more than the thickness of a sheet of photosensitive material, for example, in the case of a sheet of color photographic paper, the flatness of not more than 0.15 to 0.25 mm will be accepted. Concerning the matter, refer to FIG. 11(C). The flatness, here, is defined as a value to indicate a warp of a flat surface. In the present invention, the flatness means a warp of a surface formed on the top portion of the protrusions of the guide member 8.

Due the foregoing, a clearance between the guide member 8 and the conveyance roller 9 can be eliminated when they are contacted with each other. Therefore, the photosensitive material can be stably conveyed without causing jam and skew. When the flatness of the guide member 8 is maintained to be not more than 1 mm, it is possible to convey the photosensitive material more positively.

Resin is preferably used for the guide member 8. It is preferable to use soft or elastic material, the frictional coefficient of which is low. Therefore, fluororesin such as PTFE, PFA is used. In the case where the photosensitive material conveyance surface is slippery, PE, PP and PVC are also used. The most preferable material is a high density polyethylene resin.

Figure 12:
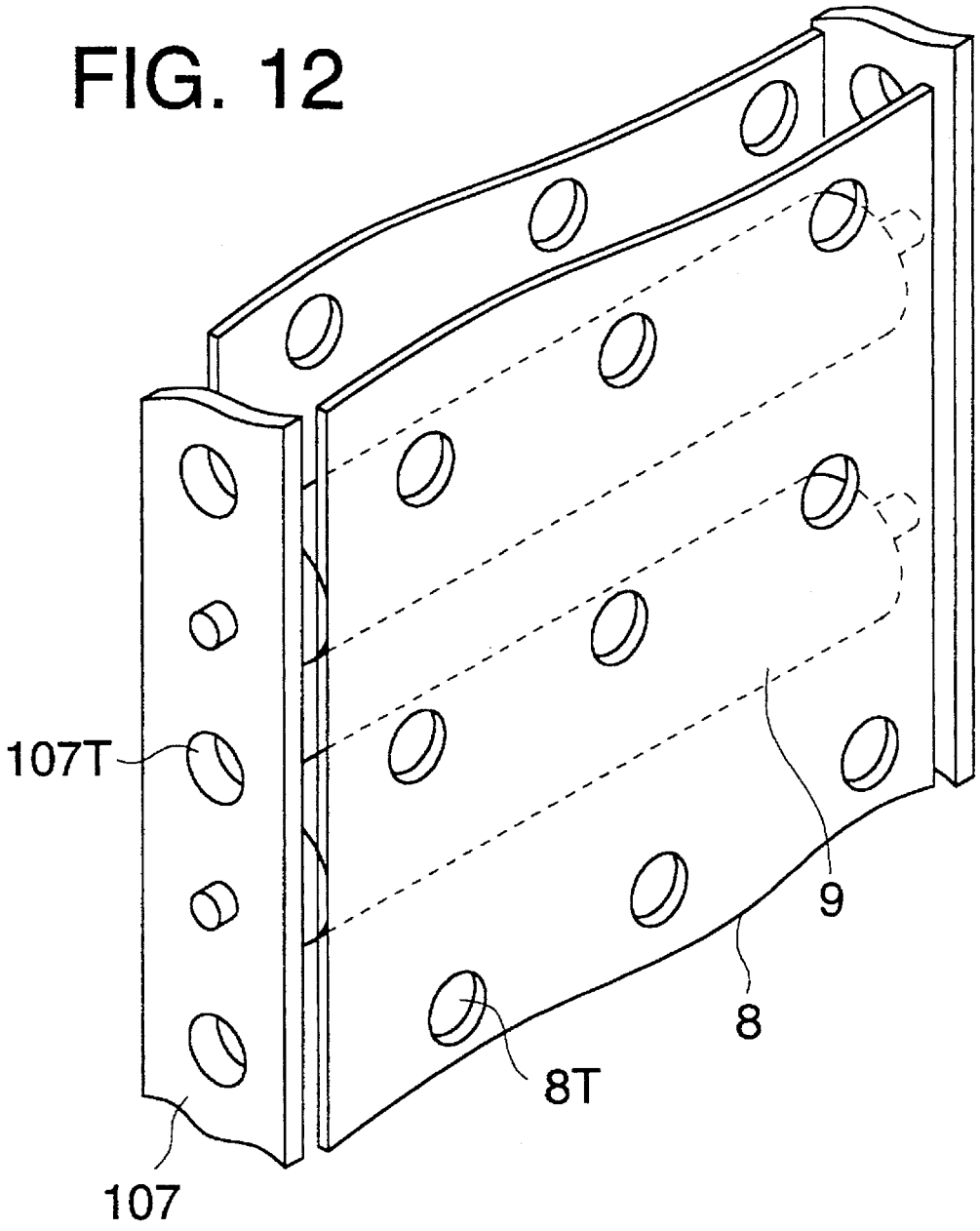
FIG. 12 is a perspective view of the processing rack having openings of the photosensitive material processing apparatus of the present invention.

FIG. 12 is a perspective view showing the processing rack side plate 107 on which openings 107T are formed and also showing the guide member 8 on which openings 8T are formed. The openings 107T may be formed at arbitrary positions on the processing rack side plate 107. It is preferable that the openings 107T are formed between the conveyance rollers 9 in which the processing solution is difficult to be flown. In the same manner, it is preferable that the openings 8T are formed between the conveyance rollers 9.

Due to the foregoing structure, the processing solution inside the processing rack 100 surrounded by the guide member 8 and conveyance roller 9 is more positively circulated, and the photosensitive material is processed more uniformly.

Figure 13:
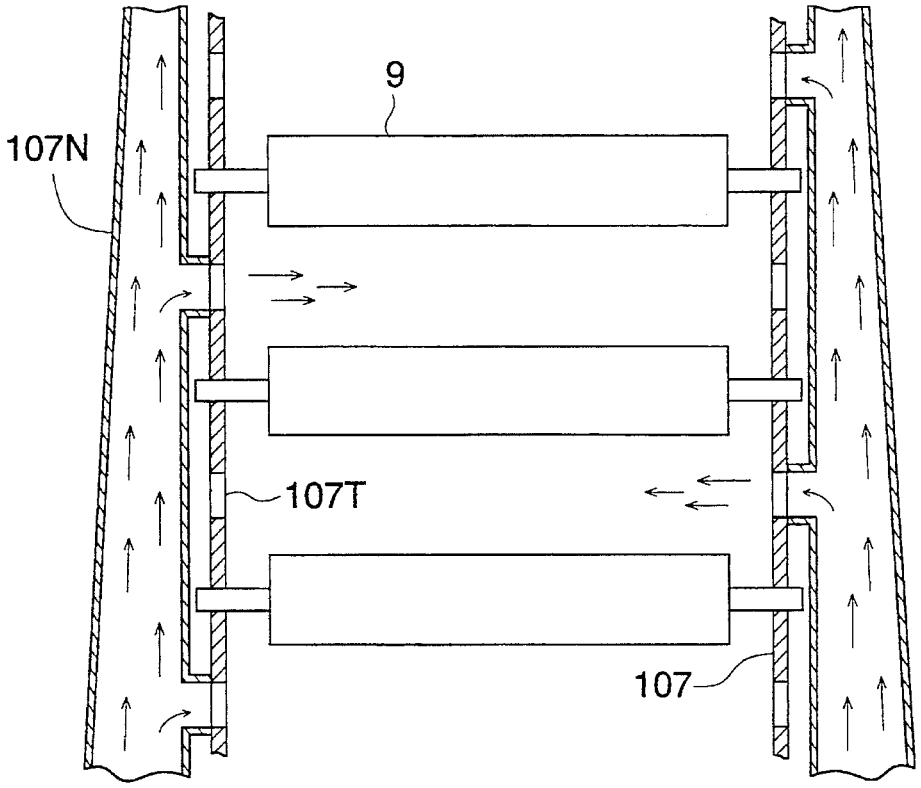
FIG. 13 is a view of the processing rack having nozzles of the photosensitive material processing apparatus of the present invention.

FIG. 13 is a schematic illustration showing a condition in which the processing solution flows in the processing rack 100 in the direction of conveyance of photosensitive material, and the processing solution is jetted out zigzag between the conveyance rollers 9. In order to jet out the solution zigzag, the nozzle 107N illustrated in FIG. 13 is used, or alternatively other means may be used.

When the processing solution is jetted out zigzag from the nozzle in the direction perpendicular to the direction of conveyance of photosensitive material, the processing solution inside the processing rack 100 surrounded by the guide member 8 and conveyance roller 9 is more positively circulated and the photosensitive material can be processed more uniformly.

Figure 14:
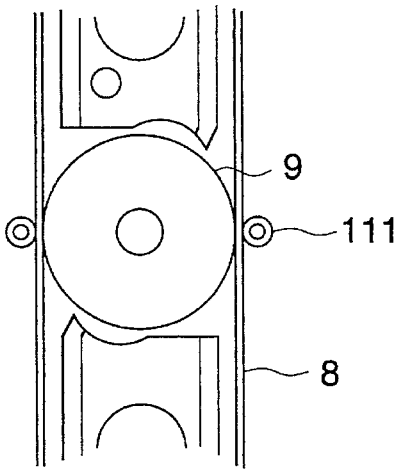
FIG. 14 is a view showing a condition in which the guide member and conveyance roller are pushed by the holding member of the photosensitive material processing apparatus of the present invention.
Figure 15:
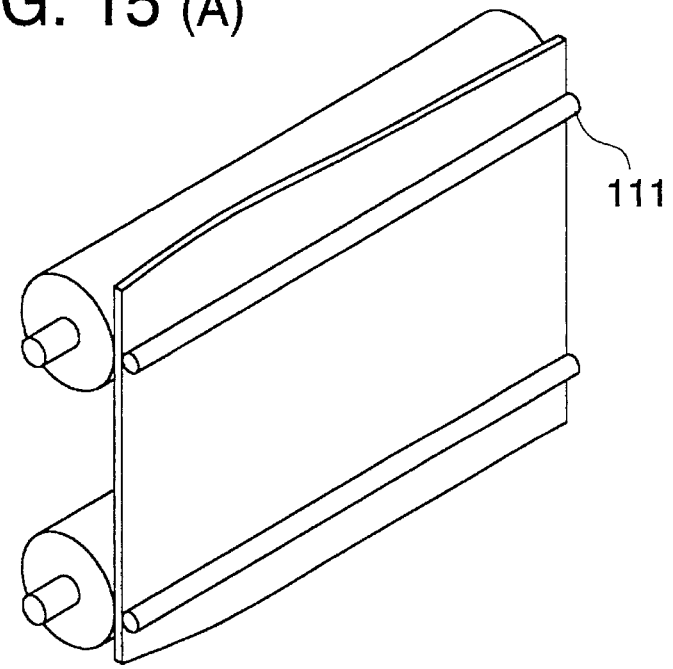
FIGS. 15(A) and 15(B) are perspective views of the holding member and conveyance roller of the photosensitive material processing apparatus of the present invention.
Figure 15:
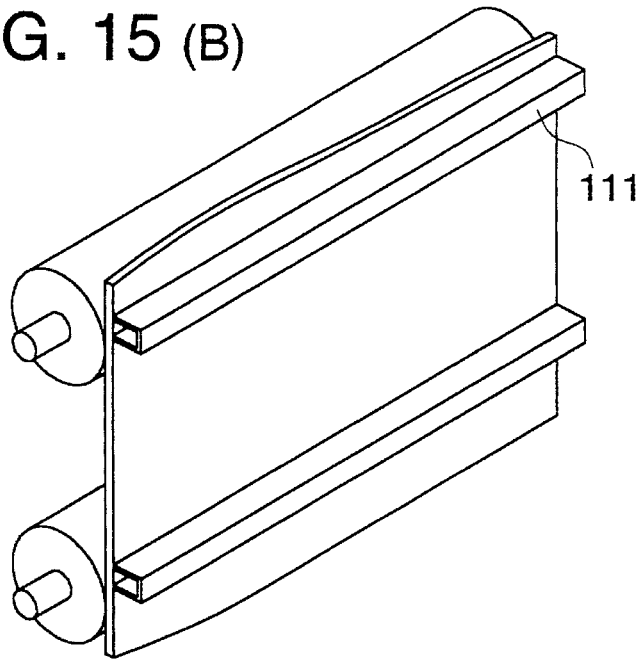

FIG. 14 is a view showing an arrangement in which the holding member 111 is arranged at a position where the guide member 8 and the conveyance roller 9 are opposed to each other. As illustrated in FIG. 15, the configuration of the holding member 111 may be a rod-shape, the outside diameter of which is uniform in the direction of width of the conveyance roller. As long as an approximately uniform dimensional accuracy can be maintained in the pressure contact portion in the direction of width of the conveyance roller 9, the configuration of the holding member 111 may be a C-shape or triangle.

As described above, the guide member 8 comes into pressure contact with the conveyance roller 9 by the action of the holding member 111. Therefore, the photosensitive material is given a conveyance force and positively conveyed in the processing rack 100. When the various holding members 11 are made of resilient material, it is possible to avoid the occurrence of non-uniform pressure contact which tends to be caused by the camber of a rigid holding member. Therefore, it is possible to convey the photosensitive material stably.

Figure 16:
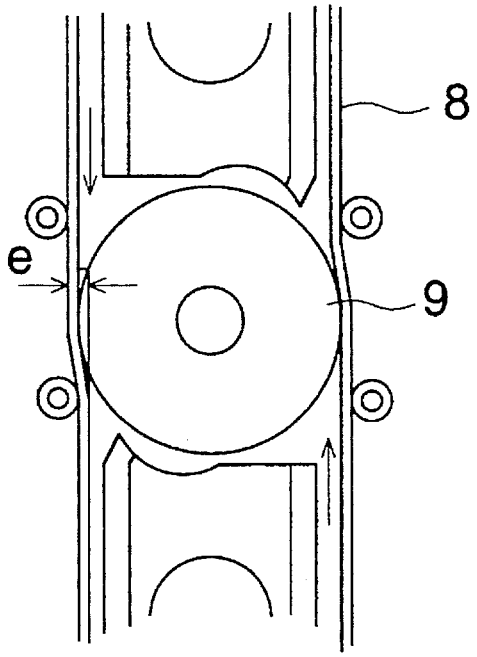
FIG. 16 is a view showing a condition in which the guide member is pushed by a portion except for the conveyance roller opposing portion.

FIG. 16 is a view showing an arrangement in which the holding member 111 pushes the guide member 8 at a position except for the opposing portion of the conveyance roller 9 to the guide member 8. In this case, the holding member 111 may be arranged either on the upstream side or the downstream side of the conveyance roller 9. Alternatively, the holding member 111 may be arranged on both sides. Concerning the pushing amount "e", depending on the resilience of the guide member 8, it is preferable that the downstream side is pushed more strongly.

As described above, when the holding member 111 is arranged at a position where the conveyance roller 9 is not opposed to the guide member 8, a conveyance force is effectively given to the photosensitive material at the position where the conveyance roller 9 is not opposed to the guide member 8. Especially when a sheet-shaped guide member 8 is attached, it is possible to allow the guide member to closely come into contact with the conveyance roller 9. Therefore, even when a camber or deformation is caused in the holding member 111, it is possible to allow the guide member to uniformly come into contact with the conveyance roller 9. Accordingly, the photosensitive material can be stably conveyed.

Figure 17:
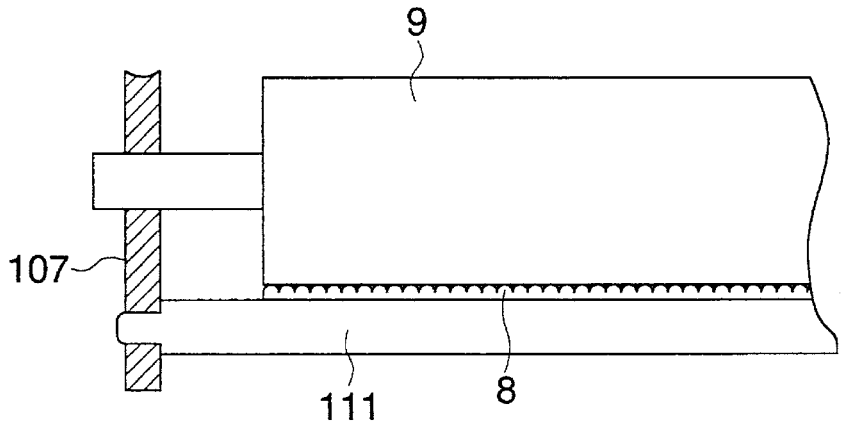
FIGS. 17(A) to 17(E) are views showing the holding member of the photosensitive material processing apparatus of the present invention, wherein the holding member is attached to the apparatus.
Figure 17:
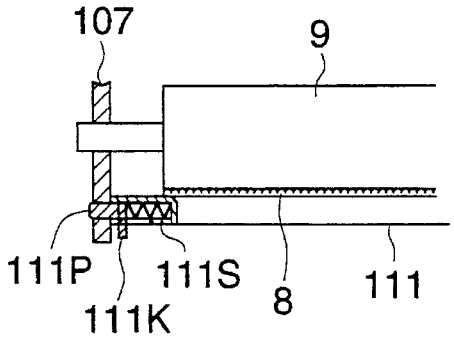
Figure 17:
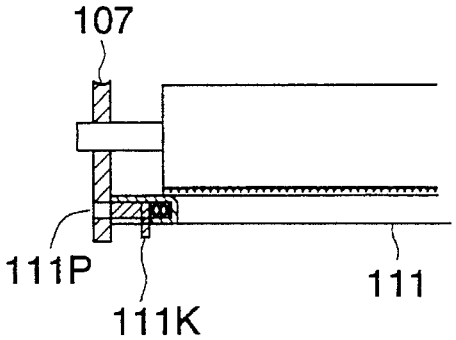
Figure 17:
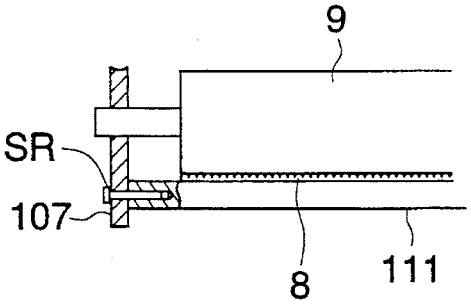
Figure 17:
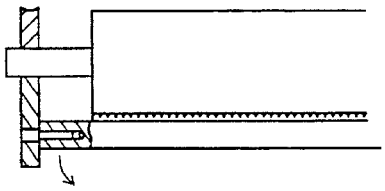

FIGS. 17(A) to 17(E) are views showing an arrangement in which a detachable holding member 111 is attached to the processing rack side plate 107. In FIG. 17(A), the holding member 111 is fixed to the processing rack side plate 107. In FIG. 17(B), a detachable holding member 111 is attached. In FIG. 17(C), the detachable holding member 111 is removed. In FIG. 17(D), a holding member 111 is attached to the processing rack side plate 107 by means of screw SR. In FIG. 17(E), screw SR is removed from the holding member 111.

Figure 5:
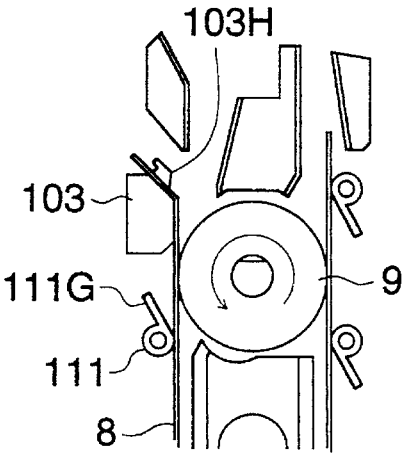
FIGS. 5(A) and 5(B) are other views showing the details of the processing rack of the photosensitive material processing apparatus of the present invention.
Figure 5:
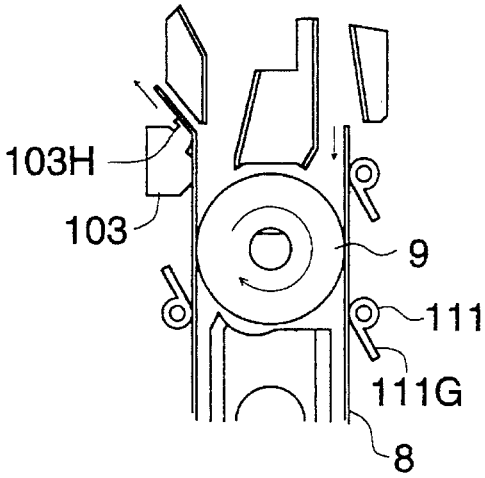

As illustrated in FIGS. 17(B) and 17(C), a pin 111P having a knob 111K is provided in a hole formed at an end of the holding member 111 in such a manner that the pin 111P can be protruded by the action of a spring 111S, and the holding member 111 is attached onto the processing rack side plate 107. In the case of detachment, as illustrated in FIG. 17(C), the pin 111P is withdrawn by the knob 111K, and in the case of attachment, as illustrated in FIG. 17(B), the pin 111P is protruded by the spring 111S. When the one-touch attaching device is employed as described above, the properties of assembly and maintenance are preferably enhanced. When the guide member 8 is attached to and detached from the processing rack 100 as illustrated in FIG. 5, the holding member 111 may be fixed to the processing rack side plate 107 by means of screw SR.

A position on the processing rack side plate 107 at which a hole is formed for attaching the holding member 111 is determined so that the pushing force of the guide member 8 given to the conveyance roller 9 can be 5 to 80 gr/cm. Due to the foregoing, the conveyance efficiency of photosensitive material is enhanced high. Depending on the materials of the conveyance roller 9 and guide member 8, for example, when the conveyance roller 9 is made of silicon rubber, the rubber hardness of which is 50 in ASTM standard D2240-68 Type A (ASTM stands for American Society for Testing and Materials), and when the guide member 8 is made of high density polyethylene, and also when a sheet of color photographic paper of 0.5 mm thickness is conveyed, the attaching hole of the holding member 111 may be provided at a position where the photosensitive material conveyance surface of the guide member 8 is curved by 1 mm in the axial direction of the conveyance roller 9 by the holding member 111.

Figure 18:
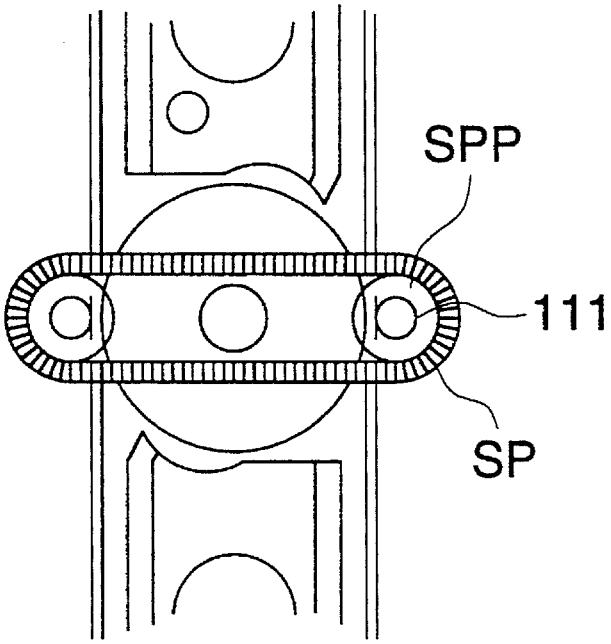
FIG. 18 is a view showing a condition in which the holding member of the photosensitive material processing apparatus of the present invention is attached to the apparatus.

The holding member 111 is not necessarily fixed to the processing rack side plate 107. As illustrated in FIG. 18, when a pressure spring SP is hooked at a spring peg SPP of the holding member 111, the guide member 102 is contacted with the conveyance roller 9 by the holding member 111 by the contact force of 5 to 80 gr/cm.

As described above, the holding member 111 by which the guide member 8 is allowed to come into pressure contact with the conveyance roller 9 is arranged in the processing rack 100, wherein the holding member 111 can be attached to and detached from the processing rack 100. The guide member 102 is pushed to the conveyance roller 9 by the holding member 111 by the contact force of 5 to 80 gr/cm. Due to the foregoing, the photosensitive material can be positively conveyed in the processing rack 100.

FIGS. 19(A) and 19(B) are views of the processing rack side plate 107 for supporting the conveyance roller 9, guide member 8 and holding member 111, wherein the processing rack side plate 107 is divided into two portions. FIG. 19(A) is a view of an inner frame unit composed of the conveyance roller 9 and processing rack side plate 107A. FIG. 19(B) is a view of an outer frame unit composed of the guide member 8, holding member 111 and processing rack side plate 107B.

Figure 20:
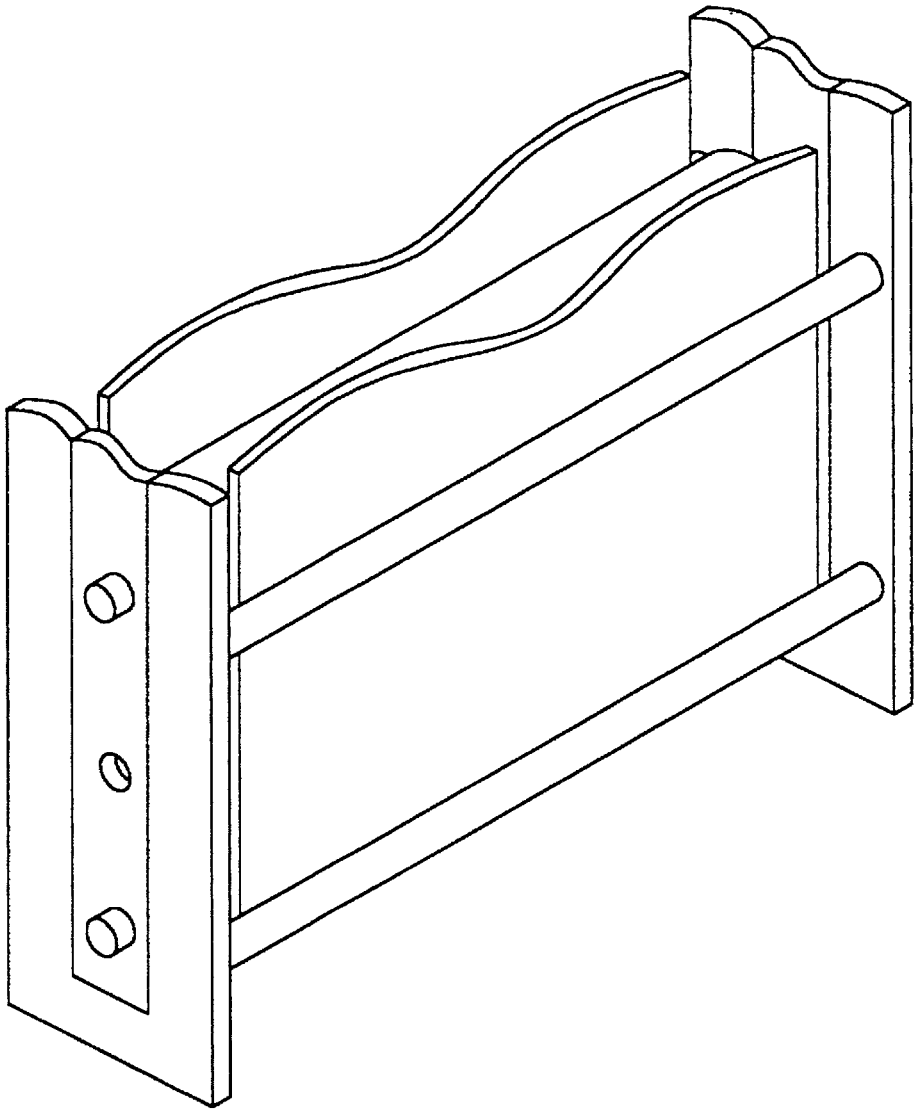
FIG. 20 is a view of the processing rack of the photosensitive material processing apparatus of the present invention.

FIG. 20 is view showing an arrangement in which the inner and outer frame units are integrated into one body, that is, the inner frame unit is inserted into the outer frame unit.

As described above, the guide member 8 is pushed to the conveyance roller 9 by the holding member 111. The inner frame having the conveyance roller 9, and the outer frame having the guide member 8 and holding member 111, are detachably integrated into one processing rack. Due to the foregoing structure, the conveyance roller 9 and the guide member 8 can be simply attached to and detached from the apparatus, so that the properties of assembly and maintenance are enhanced, and the cost can be reduced.

Figure 19:
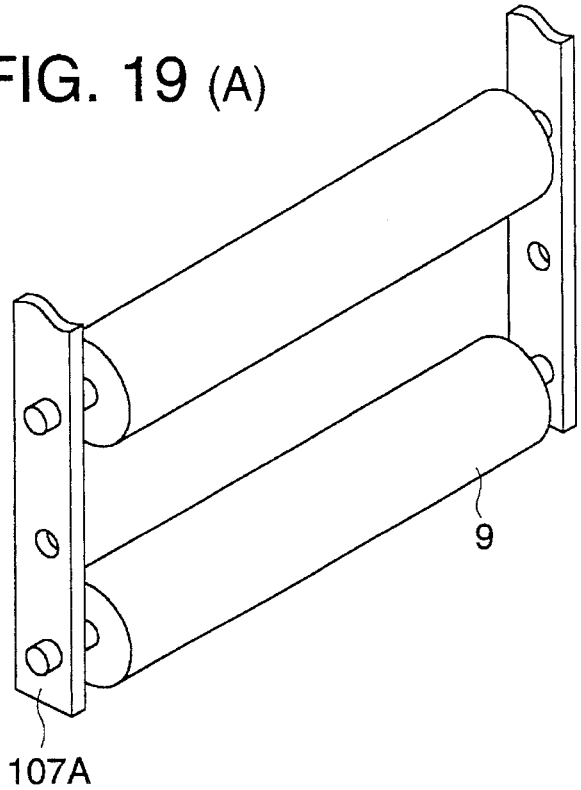
FIGS. 19(A) and 19(B) are views showing a condition in which the processing rack of the photosensitive material processing apparatus of the present invention is formed into a unit.
Figure 19:
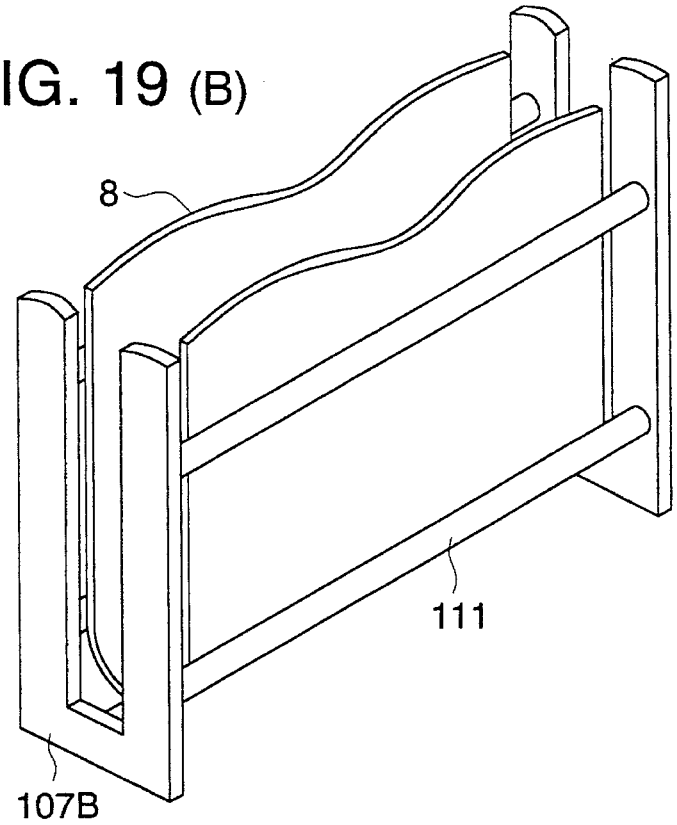
Figure 21:
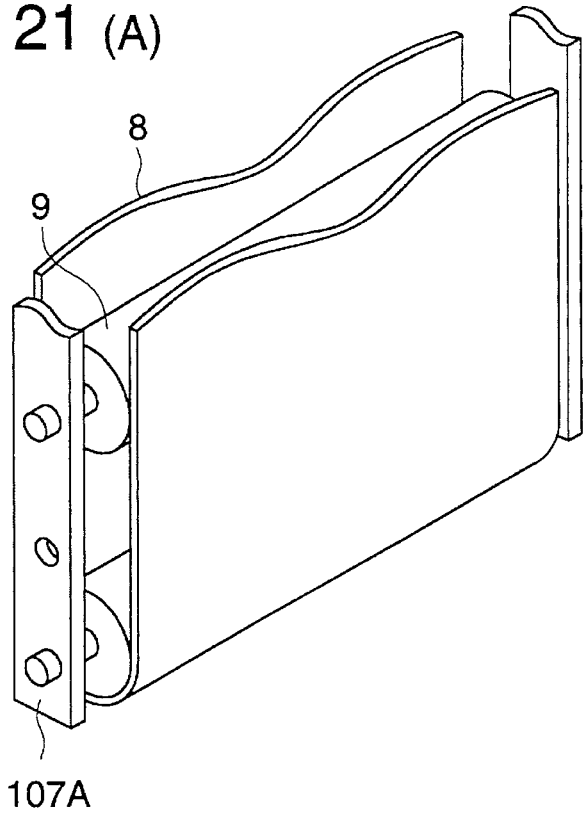
FIGS. 21(A) and 21(B) are views showing a condition in which the another example of the processing rack of the photosensitive material processing apparatus of the present invention is formed into a unit.
Figure 21:
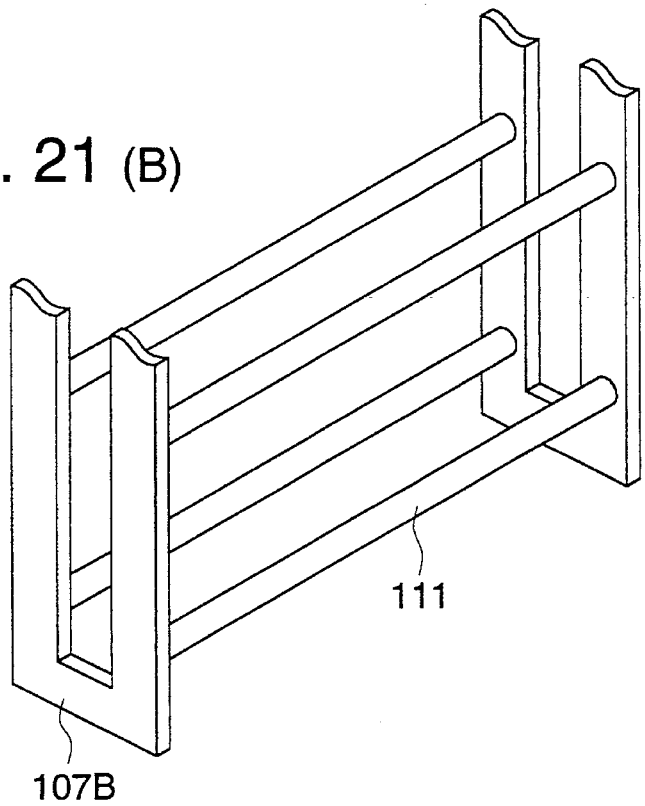

FIGS. 21(A) and 21(B) are views of the processing rack side plate 107 for supporting the conveyance roller 9, guide member 8 and holding member 111, wherein the processing rack side plate 107 is divided into two portions in the same manner as that shown in FIG. 19. FIG. 21(A) is a view of an inner frame unit composed of the conveyance roller 9, guide member 8 and processing rack side plate 107A. FIG. 21(B) is a view of an outer frame unit composed of the holding member 111 and processing rack side plate 107B.

When the inner and outer frame units are engaged and integrated, the arrangement illustrated in FIG. 20 is provided.

As described above, the guide member 8 is pushed to the conveyance roller 9 by the holding member 111. The inner frame having the conveyance roller 9 and guide member 8, and the outer frame having the holding member 111, are detachably integrated into one processing rack. Due to the foregoing structure, the conveyance roller 9 and the guide member 8 can be simply attached to and detached from the apparatus, so that the properties of assembly and maintenance are enhanced, and the cost can be reduced.

Figure 22:
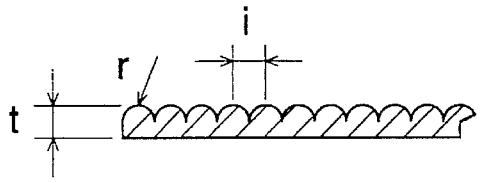
FIGS. 22(A) to 22(D) are views showing the configurations of beads of the guide member of the photosensitive material processing apparatus of the present invention.
Figure 22:
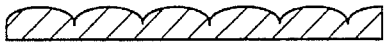
Figure 22:
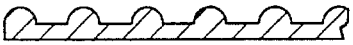
Figure 22:
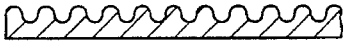
Figure 23:
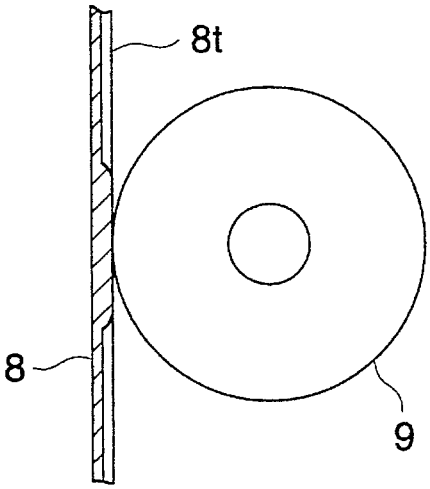
FIG. 23 is a view showing the configuration of another bead of the guide member of the photosensitive material processing apparatus of the present invention.

FIGS. 22(A) to 22(D) are views showing configurations of the cross sections of the beaded (ribbed) portions of the guide members 8. It is preferable that the bead configuration is circular arcs as illustrated in FIG. 22(A), however, as illustrated in FIG. 22(B), the bead configuration may be ellipse-shapes. In the case of a circular arc, the radius "r" of the circular arc is preferably about ½ of the thickness "t" of the guide member 8, that is, it is preferable that the radius "r" of the circular arc is not more than 0.5 mm. The pitch "i" of the bead is arbitrary, however, when consideration is given to damage of the photosensitive material, it is preferable that the pitch "i" is twice as large as the radius "r" of the circular arc of the bead. Alternatively, as illustrated in FIG. 23, beaded portions may be provided at portions other than a portion opposed to the conveyance roller 9. In this connection, a straight line denoted by 8*t* in the drawing a line on the top of the bead.

Due to the foregoing structure, snaking and skewing of the photosensitive material caused in the bead direction, that is, in the conveyance direction can be avoided, so that the photosensitive material can be smoothly conveyed. When the beads are eliminated from a portion opposed to the conveyance roller 9, the surface of the conveyance roller 9 is not damaged by the deformation of the beads.

It is preferable that a lubricant is added to the guide member 8, for example, when the guide member 8 is made of PE, it is preferable that higher fatty amic acid is added.

When the lubricant is retained in the material of the guide member 8 as described above, friction caused between the guide member 8 and the photosensitive material is reduced, and the photosensitive material is more smoothly conveyed.

In the present invention, the performance of the apparatus is influenced by the material and hardness of the conveyance roller.

Next, an example of the conveyance roller will be explained below.

Figure 24:
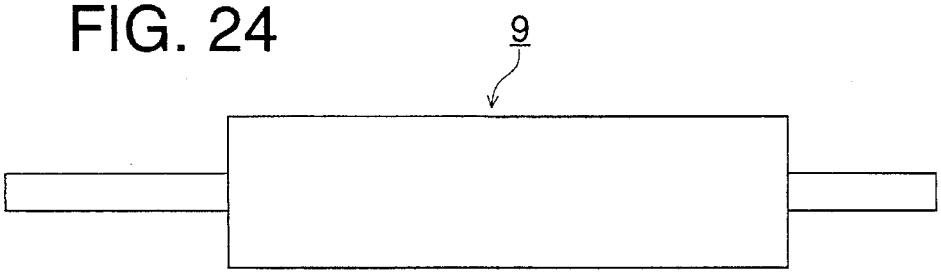
FIG. 24 is a front view of the conveyance roller of the present invention.

FIG. 24 is a front view of the first example of the roller, the surface of which is covered with a layer of porous plastics. Porous plastics is provided in such a manner that plastic fiber is formed into a cylindrical shape and subjected to thermal fusion so as to be solidified. For example, one example is composed in such a manner that non-woven fabric or woven fabric is solidified into a cylindrical filter shape. Another example is made of sintered plastic material. This example is composed of a cylindrical filter-shaped body made of sintered plastic particles or plastic fiber. Examples of the processing tanks in which this conveyance roller is preferably used are: a color development tank 11; bleaching and fixing tank 12; and first, second and third stabilization tanks 13, 14, 15, which are used for the photosensitive material processing apparatus described in FIG. 1. Other examples of the processing tanks in which this conveyance roller is preferably used are: a development tank, bleaching tank, fixing tank, washing tank, and rinsing tank, which are used for other automatic developing apparatus. When the surface layers of the conveyance rollers arranged in these processing tanks are made of porous plastics, the conveyance rollers exhibit an excellent performance.

When the aforementioned conveyance rollers are used in the processing solution tank of a photosensitive material processing apparatus, a sheet of photosensitive material is not damaged in the process of conveyance, and the conveying capacity of the conveyance roller arranged in the processing solution tank is enhanced, and further the occurrence of slippage and skew is greatly reduced. Accordingly, the conveyance rollers described above are preferably used when sheets of photosensitive material are conveyed at high speed. Especially when the conveyance speed is not less than 2500 mm/min, remarkable effects can be provided by these conveyance rollers.

Figure 25:
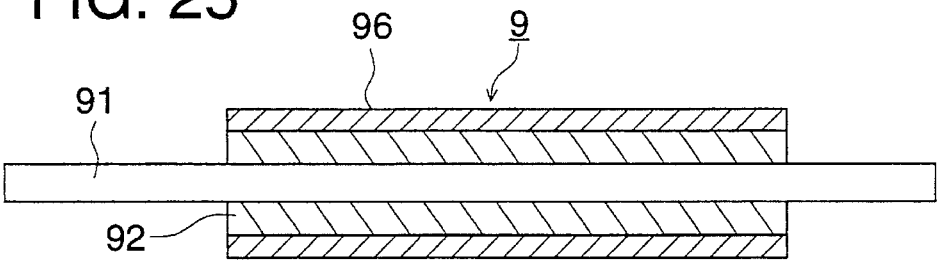
FIG. 25 is a sectional view of the conveyance roller of the present invention.

FIG. 25 is a sectional front view of the conveyance roller 9 of the second example. As illustrated in FIG. 25, only the outer circumferential portion of the barrel composing roller 92 is made of porous plastics, that is, this conveyance roller is made by a multi-layer structure. Compared with the conveyance roller of the first example which is made by a simple structure, the conveyance roller of the second example is excellent in the mechanical strength, and the durability is high for the prevention of occurrence of slippage and skew. In this connection, there are provided shafts 91 on both end portions of the barrel composing roller 92, and these shafts 91 compose engaging portions with which bearings are engaged and also compose a drive force transmitting portion.

Examples of plastic materials to compose the barrel roller are: polyolefine such as polypropylene and polyethylene, phenol resin, vinyl chloride, polyphenylene sulfide, and fluororesin. Examples of metals to compose the barrel roller are: stainless steel such as SUS304, SUS316, SUS316L and titanium. Examples of rubbers to compose the barrel roller are: silicon rubber and ethylene-propylene rubber. The above materials are preferably used from the viewpoints of chemical resistance property, cost and processability.

The barrel composing roller is composed of a stainless steel pipe covered with hard resin such as hard vinyl chloride and phenol resin. Also, the barrel composing roller is composed of a stainless steel pipe covered with rubber such as silicon rubber and ethylene-propylene rubber so that the hardness of the roller surface can be adjusted. Further, several materials described above may be formed into a multi-layer and cover the stainless steel pipe of the barrel , composing roller. The barrel composing roller may be formed to be columnar or hollow.

In the third example, the material of the surface layer of the conveyance roller is described. Examples of usable porous plastics are: polyolefine such as polypropylene and polyethylene, polyester, polyacrylonitrile, aliphatic polyamide, aromatic polyamide, polyphenylene sulfide, fluororesin, polyurethane, silicone, and ethylene-propylene. Alternatively, the porous plastics may be a compound material containing at least the resins or the rubbers described above. These plastic materials are preferably used from the viewpoints of enhancing the chemical resistance property and reducing the costs.

In the fourth example, the preferable material of the surface layer of the conveyance roller is prescribed. A compound material of polypropylene and polyethylene is used for the porous plastics to be coated on the surface of the roller. This compound material is excellent in the chemical resistance, cost, and roller processability. Therefore, this compound material is preferably used.

Figure 26:
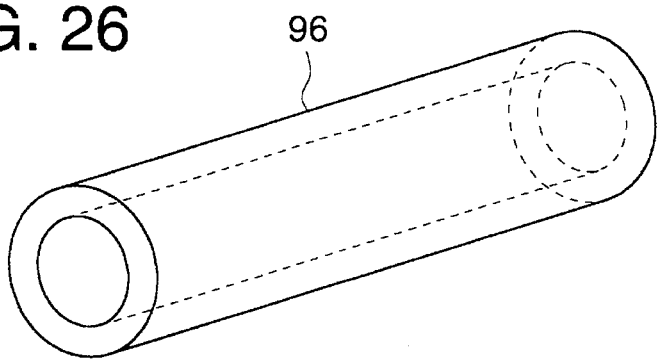
FIG. 26 is a perspective view of the cylindrical member.
Figure 27:
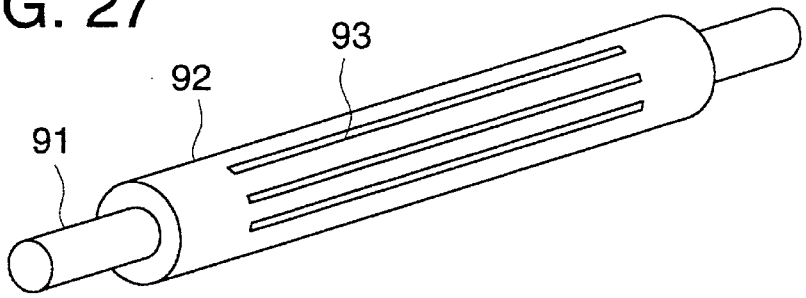
FIG. 27 is a perspective view of an example of the barrel composing roller.
Figure 28:
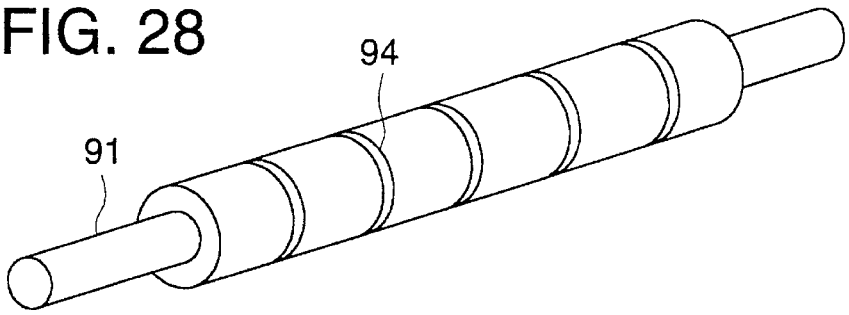
FIG. 28 is a perspective view of an example of the barrel composing roller.

The fifth example relates to a method for manufacturing the conveyance roller. A cylindrical member 96 is made of porous plastics as illustrated in the perspective view of FIG. 26. A barrel composing roller 92 is press-fitted into the cylindrical member 96. In this way, the conveyance roller 9 is manufactured. As illustrated in FIGS. 27 and 28, which are perspective views of the barrel composing roller, as a means for positively fixing the cylindrical member 96 to the barrel composing roller 92, there are provided a plurality of grooves 93 on the outer circumferential surface of the barrel composing roller 92 in the axial direction, or alternatively there are provided a plurality of grooves 94 on the outer circumferential surface of the barrel composing roller 92 in the radial direction. When adhesive is applied to the press-fitting portion, it is possible to strongly fix the cylindrical member 96 to the barrel composing roller 92. In this connection, examples of the usable porous plastics are: a CP Filter manufactured by Chisso Co.; and a High Molecular Porous Body Spacy manufactured by Spacy Chemical Co.

Figure 29:
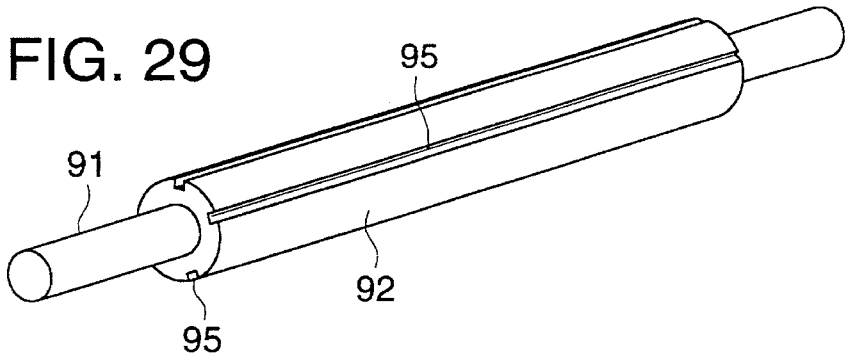
FIG. 29 is a perspective view of an example of the barrel composing roller.
Figure 30:
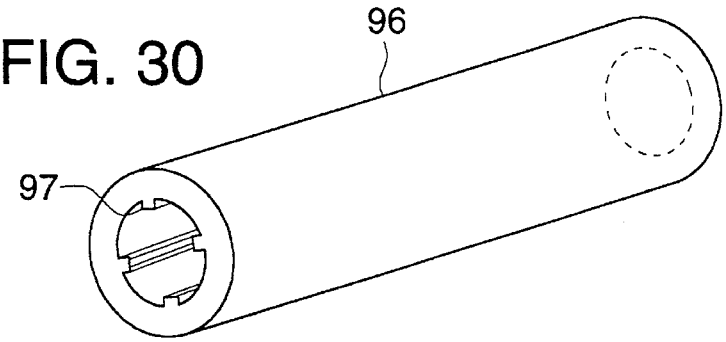
FIG. 30 is a perspective view of an example of the cylindrical member.

As illustrated in FIG. 29 which is a perspective view of the barrel composing roller, and also as illustrated in FIG. 30 which is a perspective view of the cylindrical member, protrusions 97 provided on the inner circumferential of the cylindrical member 96 in the axial direction are press-fitted into engaging grooves 95 provided on the outer circumferential surface of the barrel composing roller 92 in the axial direction. In this way, the cylindrical member 96 is fixed to the barrel composing roller 92 in the circumferential direction. In the case where there is a possibility that the cylindrical member 96 shifts in the axial direction, adhesive is applied to the engaging portions. In this way, the cylindrical member 96 is more positively fixed to the barrel composing roller 92.

Figure 31:
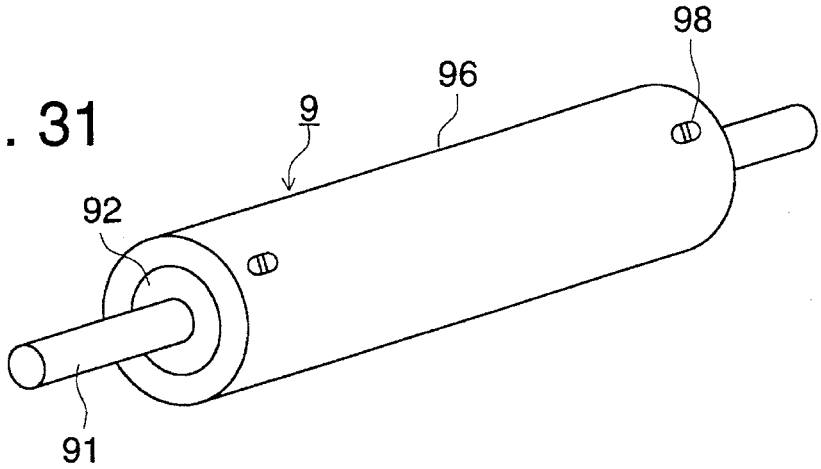
FIG. 31 is a perspective view of an example of the conveyance roller of the present invention.

As illustrated in a perspective view of FIG. 31, after the barrel composing roller 92 has been press-fitted into the cylindrical member 96, both may be fixed with screws 98 provided from the circumference to the axis of the roller. When adhesive is applied to the fixing screws, they are not loosened, so that the barrel composing roller 92 and the cylindrical member 96 can be completely integrated into one unit.

Figure 32:
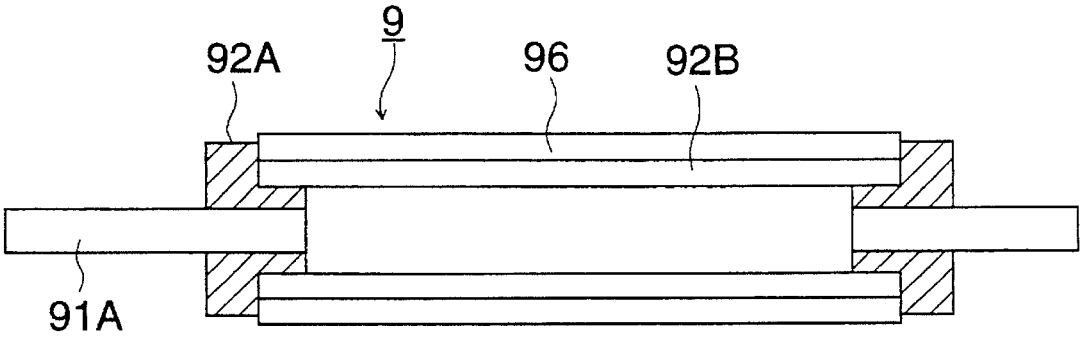
FIG. 32 is a sectional front view of an example of the conveyance roller of the present invention.

A conveyance roller illustrated in the sectional front view of FIG. 32 is composed in the following manner: The barrel composing roller is divided into 2 portions. Flanges 92A are press-fitted onto both sides of the cylindrical body 92B. Drive connecting shafts 91A are attached to the outsides of both flanges 92A. A cylindrical member 96 made of porous plastics is press-fitted around the outermost circumference of the barrel composing roller.

Figure 33:
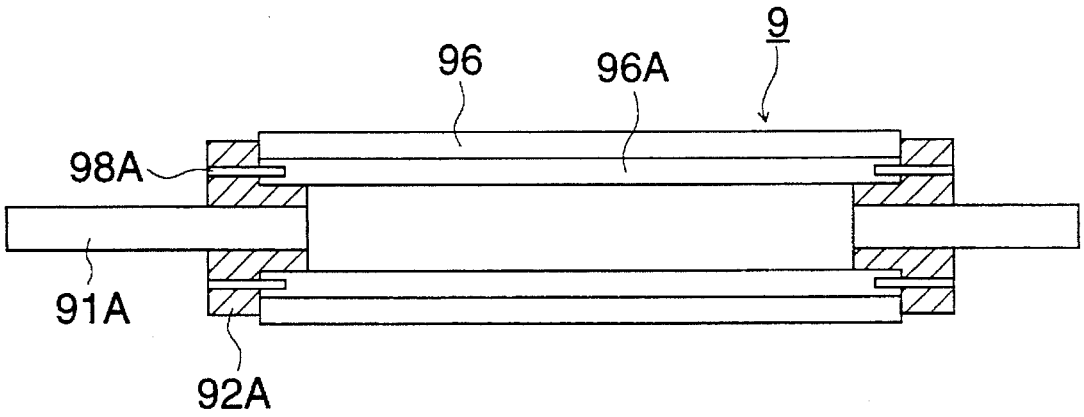
FIG. 33 is a sectional front view of an example of the conveyance roller of the present invention.

In the structure described above, when the barrel composing roller is strongly press-fitted into the cylindrical member, they can be tightly fixed to each other. However, when the cylindrical body is connected with both flanges by fixing screws 98A as illustrated in the sectional front view of FIG. 33, they can be completely fixed to each other.

It is preferable that the conveyance roller is subjected to polishing for the purpose of setting the outer diameter of the conveyance roller after the barrel composing roller has been press-fitted into the cylindrical portion of the porous plastics.

In the sixth example, a roller manufacturing method is provided, in which plastic fibers are put on the surface of the barrel composing roller and then subjected to thermal fusion and solidified so that a porous plastic roller can be provided. This method is advantageous in that the dimensional accuracy is high, and the porous plastic member and the barrel composing roller are strongly adhered to each other. In this case, it is preferable that the outer circumferential surface layer made of porous plastics is finally subjected to polishing.

In the conveyance roller described in one of the first embodiment to the sixth embodiment, when the conveyance roller is used on the emulsion surface side of the photosensitive material sheet, the conveyance performance can be sufficiently enhanced without damaging the surface of the photosensitive material sheet.

Further, in aforementioned FIG. 2, it is discovered that the conveyance roller of the present invention is used for a photosensitive material processing apparatus in which guide member 8 and conveyance roller 9 are arranged being opposed to each other in the processing solution in processing rack 100 or processing tank 10, and a photosensitive material sheet is conveyed while it is pressed between guide member 8 and conveyance roller 9. Due to the foregoing, the conveyance capacity of the conveyance roller can be enhanced, and the occurrence of slippage and skew can be greatly reduced.

Conventionally, it is impossible to convey a photosensitive material sheet only by the one-side roller conveyance conducted by a rubber roller. However, when the roller of the present invention, the surface of which is covered with porous plastics, is used, a frictional force generated by the roller and the emulsion surface of the photosensitive material sheet is higher than a frictional force generated by the guide and the reverse side of the photosensitive material sheet. Therefore, the photosensitive material sheet can be smoothly conveyed.

Figure 34:
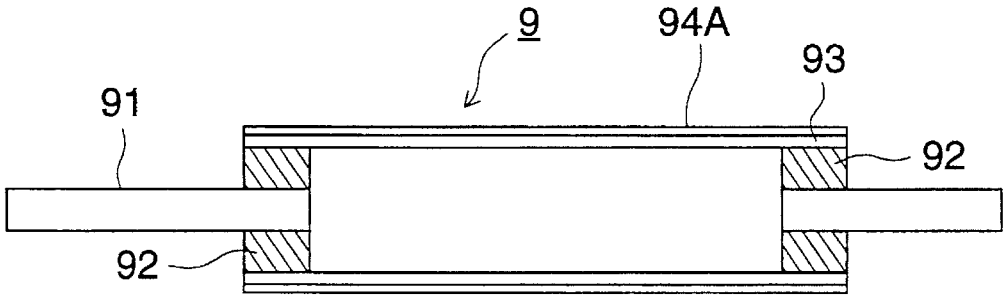
FIG. 34 is a sectional view in the axial direction of an example of the conveyance roller of the present invention.
Figure 35:
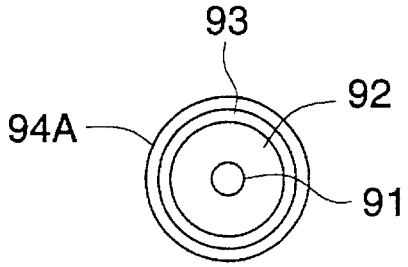
FIG. 35 is a sectional view of an example of the conveyance roller of the present invention, wherein the view is taken in a direction perpendicular to the axis.
Figure 36:
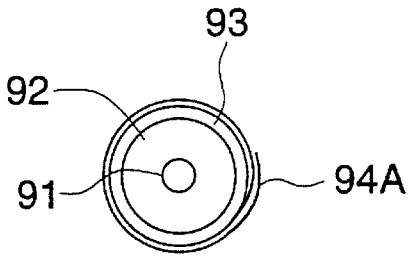
FIG. 36 is a sectional view of an example of the conveyance roller of the present invention, wherein the view is taken in a direction perpendicular to the axis.

Configuration of the conveyance roller 9 of the seventh example of the present invention is shown in FIG. 34 which is a sectional view in the axial direction and also shown in FIGS. 35 and 36 which are sectional views in a direction perpendicular to the axial direction. An arrangement of the conveyance roller 9 is described as follows.

The conveyance roller is composed as follows: A barrel composing roller 93 is arranged at the center of the conveyance roller. The mechanical strength of the entire conveyance roller is enhanced by the barrel composing roller 93. The barrel composing roller 93 is made of phenol (PF) resin, and the length is 240 mm, and the outer diameter is 25 mm. Bosses 92 made of denatured polyphenylene ether (denatured PPE), each boss 92 provided with a roller shaft 91 made of stainless steel SUS316L, are respectively press-fitted into both end portions of the barrel composing roller 93. A non-woven fabric sheet made of polypropylene (PP) is wound around the outermost circumference of the barrel composing roller 93 so that the outer diameter can be 29 mm. As illustrated in FIG. 36, an end of the non-woven fabric sheet is subjected to heat-seal, and the outermost circumferential layer 94A is provided while the tension of the non-woven fabric sheet is adjusted. In this case, the hardness of the non-woven fabric sheet is 36 according to the Standard 0101 of Japanese Rubber Institution.

The structure of the eighth example of the present invention is the same as that of the seventh example. However, the tension of the non-woven fabric sheet is adjusted so that the hardness of the roller surface can be 60 in this example.

Figure 37:
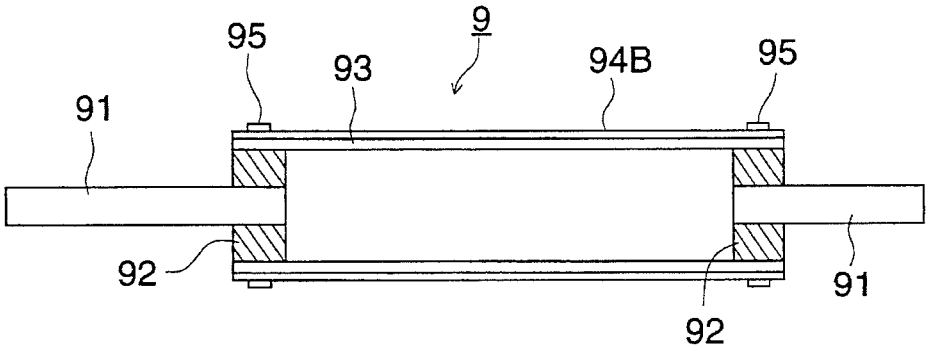
FIG. 37 is a sectional view in the axial direction of an example of the conveyance roller of the present invention.
Figure 38:
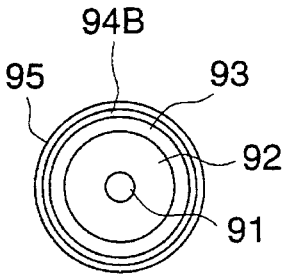
FIG. 38 is a sectional view of an example of the conveyance roller of the present invention, wherein the view is taken in a direction perpendicular to the axis.

Configuration of the conveyance roller 9 of the ninth example of the present invention is shown in FIG. 37 which is a sectional view in the axial direction and also shown in FIG. 38 which is a sectional view in a direction perpendicular to the axial direction. An arrangement of the conveyance roller 9 is described as follows.

The configuration and dimensions of the barrel composing roller 93 are the same as those of the seventh example, however, material of the barrel composing roller 93 is changed from phenol to polyphenylene ether (denatured PPF). Material of the roller shaft 91 is changed from stainless steel SUS316L to denatured polyphenylene ether, and material of the boss 92 is the same as that of the roller shaft 91, so that the boss can be integrated with the roller shaft 91. The outermost circumferential layer 94B is made of mollten of polypropylene (PP), and the outer diameter is determined to be 29 mm. At this time, the hardness of the outermost circumferential layer is 8 according to the Standard 0101 of Japanese Rubber Institute. In order to prevent the mollten from loosening, fixing bands 95 made of polypropylene (PP) are provided on the outer circumference on both sides of the roller.

Figure 39:
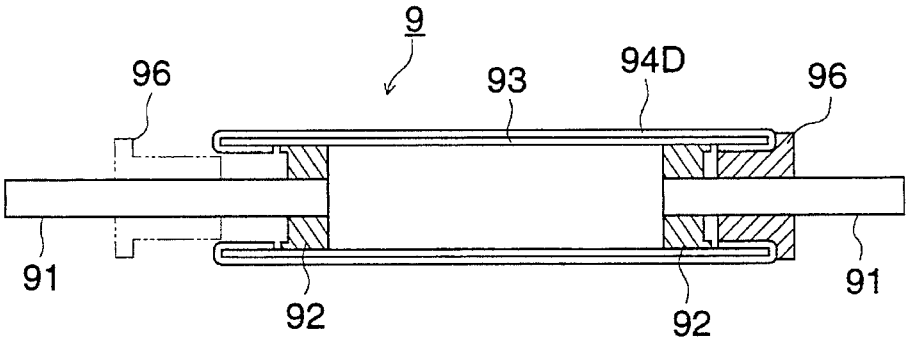
FIG. 39 is a sectional view in the axial direction of an example of the conveyance roller of the present invention.

A conveyance roller 9 of the tenth example of the present invention is illustrated in FIG. 39 which is a sectional view taken in the axial direction. In this case, the material and dimensions of the barrel composing roller 93 are the same as those of the barrel composing roller of the ninth example. The boss 92 and roller shaft 91 of this example are the same as those of the seventh example. Different points are described as follows. Although the material of the mollten made of polypropylene (PP) used for the outermost circumferential layer 94D is the same and also the outer diameter 29 mm is the same, both end portions of the mollten are folded into both end portions of the barrel composing roller 93 and fixed when mollten fixing members 96 made of denatured polyphenylene ether (denatured PPE) are inserted from both sides as shown in FIG. 39. The hardness of the outermost circumferential layer 94D is 8 according to the Standard 0101 of Japanese Rubber Institute.

Figure 40:
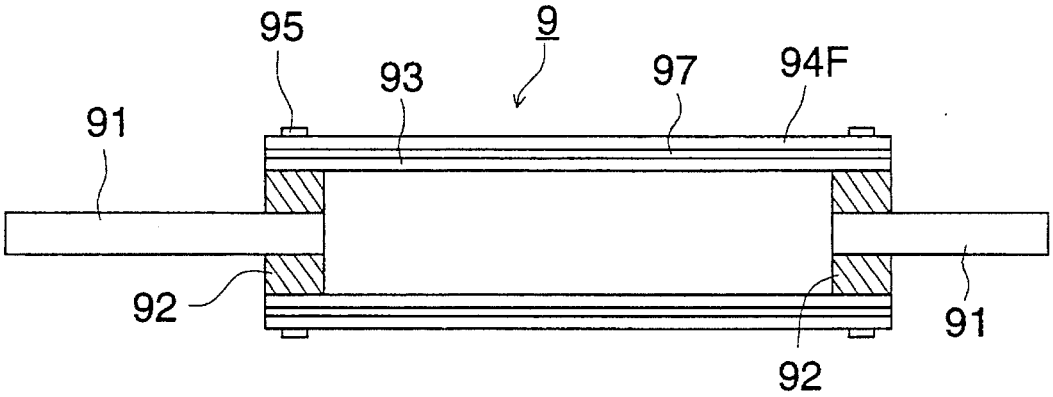
FIG. 40 is a sectional view in the axial direction of an example of the conveyance roller of the present invention.
Figure 41:
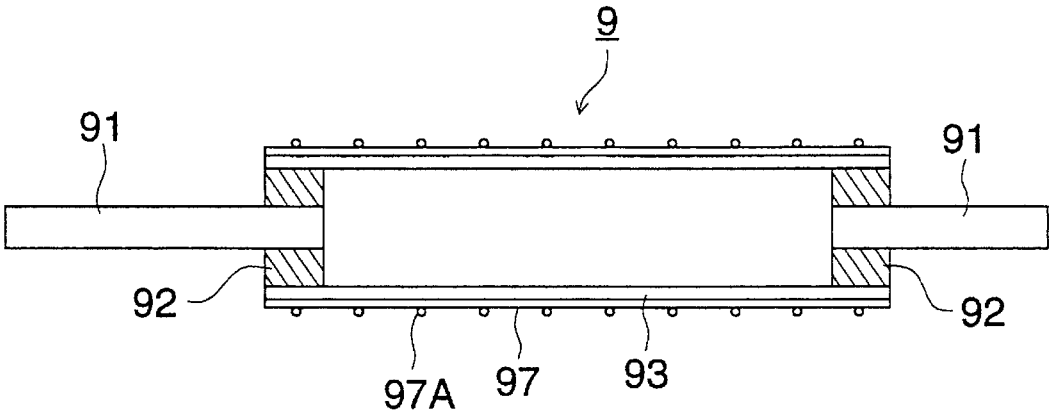
FIG. 41 is a sectional view in the axial direction of the barrel composing roller of the conveyance roller of the present invention.

The eleventh example of the present invention is shown in the sectional views of FIGS. 40 and 41 in which the sections taken in the axial direction are shown. In this example, there is provided an outer circumferential layer 97 on the barrel composing roller 93 made of phenol resin, and further there is provided an outermost circumferential layer 94F of the mollten on the outer circumferential layer 97. The outer circumferential layer 97 is made of silicon rubber, the rubber hardness of which is 60 in ASTM standard D2240-68 Type A. As illustrated in FIG. 41, there are provided minute protrusions 97A on the silicon rubber layer. FIG. 41 is a sectional view of the conveyance roller taken in the axial direction, and this drawing shows an arrangement in which the outermost circumferential layer is removed. Due to the foregoing structure, when the outermost circumferential layer 94F of the mollten is provided, it can be tightly adhered onto the outer circumferential layer 97. Accordingly, even if an intensity of tension is reduced when the outermost circumferential layer is wound, there is no possibility of slippage between the layers.

As described above, in the seventh and eighth examples of the present invention, the barrel composing roller is made of phenol, and in the ninth example, the barrel composing roller is made of polyphenylene ether (denatured PPE). However, it should be noted that the present invention is not limited to the specific material. Other examples of usable material for the barrel composing roller are: polyolefine, polyphenylene sulfide, vinyl chloride, stainless steel of SUS and titanium. As a result of the experiment made by the present inventors, it was confirmed that the above materials were used for the barrel composing roller without causing any problems.

In the seventh and eighth examples of the present invention, the outermost circumferential layer of the conveyance roller is made of non-woven fabric of polypropylene (PP), and in the ninth and tenth examples of the present invention, the outermost circumferential layer of the conveyance roller is made of the mollten of polypropylene (PP). However, it should be noted that the present invention is not limited to the specific material. Fabric or non-woven fabric made of the following fibers may be used: polyolefine fibers such as polyethylene fibers, polyester fibers, polyacrylonitrile fiber, aliphatic polyamide fibers, aromatic compound, polyamide fibers, and polyphenylene sulfide fibers. When the above fabric or non-woven fabric is used, it is possible to maintain the hardness to be not more than 60. In this way, it is possible to convey the photosensitive material smoothly, and end portions of the photosensitive material are not stained. By way of example of the conveyance roller made of polyurethane prescribed by the third example described before, "Uettoron" manufactured by Kanebo, Ltd. was used, and it was confirmed that the conveyance property was high and the occurrence of stain at the edge was prevented. In this connection, when "Uettoron" was used for the conveyance roller at this time, the surface hardness was 16 to 18 according to the result of measurement stipulated in the standard described before. Polyurethane material is not limited to the above specific example, but "Rubycell" manufactured by Toyo Polymer Co, Ltd. may be used, the hardness of which is 10 to 70 according to the result of measurement stipulated in the standard described before. An example of porous material except for the polyurethane material is silicon rubber, the hardness of which is 15 to 17 according to the result of measurement stipulated in the standard described before. It was confirmed that the conveyance property was high and the occurrence of stain at the edge was prevented when this material was used for the conveyance roller.

As described above, the effects obtained by the seventh embodiment through the eleventh embodiment of our invention will be explained below. When the hardness of the outermost circumferential layer of the conveyance roller is not more than 60 defined by the SRIS Standard 0101 of Japanese Rubber Institution, contamination of paper caused by the pressure contact of the guide member and conveyance roller with the photographic paper can be avoided, that is, unevenness of an image caused when an edge portion of photographic paper is stained with the processing solution can be avoided.

Specifically, when a barrel composing roller is arranged inside the outermost layer of the conveyance roller, it is possible to increase the mechanical strength of the conveyance roller, and further it is possible to increase the durability of the conveyance roller.

In this case, the conveyance roller can be composed in the following manner:

On the outer circumference of the barrel composing roller, an outer circumferential layer is provided, which is made of rubber such as silicon rubber or ethylene-propylene rubber. Alternatively, an outer circumferential layer is provided, which is made of plastics such as polyolefine, polyester, polyacrylonitrile, aliphatic polyamide, aromatic polyamide, or polyphenylene sulfide. The outermost circumferential layer on the conveyance roller is made of material, the hardness of which is not more than 60 defined by the SRIS Standard 0101 of the Japanese Rubber Institute. At least one outermost layer is provided on the conveyance roller.

The outermost circumferential layer may be provided around the barrel composing roller or the outer circumferential layer by means of adhesion or fusion. Also, the outermost circumferential layer may be constructed in such a manner that the outermost circumferential layer is capable of being removed from the barrel composing roller. In this case, it is preferable that the barrel composing roller or the outer circumferential layer is made of rubber, so that the occurrence of slippage of the outermost circumferential layer can be prevented when the conveyance roller is rotated. Alternatively, minute protrusions may be provided on the outer circumferential surface of the barrel composing roller or the outer circumferential layer, so that the occurrence of slippage of the outermost circumferential layer can be prevented when the conveyance roller is rotated.

When the barrel composing roller is made of one of the following materials, the mechanical strength of the barrel composing roller can be increased, and the durability of the conveyance roller can be greatly enhanced:

Polyolefine, polyphenylene sulfide, denatured polyphenylene oxide (denatured polyphenylene ether), phenol resin, vinyl chloride, stainless steel, and titanium.

Further, in order to make the conveyance ability to be compatible with the effect for preventing the paper end portion from contamination of the processing solution when the photosensitive material sheet is pressed by the guide member and the conveyance roller, it is preferable that the outermost circumferential layer on the conveyance roller is composed of fabric or non-woven fabric made of one of the following materials:

Polyolefine fiber, polyester fiber, polyacrylonitrile fiber, aliphatic polyamide fiber, aromatic polyamide fiber, and polyphenylene sulfide fiber. In this connection, polyolefine fiber includes polypropylene fiber and polyethylene fiber.

When the fabric or non-woven fabric made of plastic fiber is used, it is possible to easily obtain a preferable hardness, and a stable conveyance capacity for conveying photosensitive material sheets can be provided.

Still further, it is preferable that the outermost circumferential layer of the conveyance roller is made of the mollten. When the mollten is used for the outermost circumferential layer of-the conveyance roller, the conveyance accuracy can be enhanced and further the contamination of the paper end portions can be remarkably prevented when the photosensitive material sheet is pressed between the guide member and the conveyance roller.

It is preferable that polypropylene is used for the mollten from the viewpoints of enhancing the durability and chemical resistance and also from the viewpoint of reducing the cost. When polypropylene is used for the mollten, the conveyance ability is enhanced when photosensitive material sheets pass through the conveyance roller. In the case where photosensitive material sheets do not pass through the conveyance roller, the sliding property between the guide member and the conveyance roller can be improved.

When end portions of the mollten are subjected to thermal fusion, it is possible to prevent the mollten from fraying on the cutting plane. That is, it is possible to prevent threads from attaching to the photosensitive material sheets. Therefore, it becomes possible to stably process the photosensitive material sheets.

When a loop-shaped face of the mollten is arranged on the barrel composing roller side, the occurrence of skew is not caused in the process of conveyance of a photosensitive material sheet, and further contamination of paper end portions can be prevented when the photosensitive material sheet is pressed by the guide member and the conveyance roller.

In order to make a comparison with the seventh to eighth examples of the conveyance roller of the present invention, two comparative examples are shown as follows.

In Comparative Example 1, the configuration and material of the conveyance roller are the same as those shown in FIGS. 34, 35 and 36. The outer diameter of the barrel composing roller 93 is 26 mm, which is larger than that of the seventh, eighth and ninth examples by 1 mm. Since the outer diameter of the outermost circumferential layer is 29 mm, the outermost circumferential layer is thin, and further the tension of the non-woven fabric sheet is adjusted to be high. Therefore, the hardness is 62 according to the Standard 0101 of Japanese Rubber Institute, which is higher than the hardness in the above examples.

In Comparative Example 2, the configuration and material of the conveyance roller are the same as those of Comparative Example 1, however, the tension of the non-woven fabric is adjusted to be higher, so that the hardness is set at 85.

In the seventh, eighth, ninth and tenth examples, and also in Comparative Examples 1 and 2, the hardness was measured by Durometer Asker Type C manufactured by Kobunshi Keiki Co.

Asker C test is for testing the hardness of an object.

As shown in FIG. 43, Asker C test is executed with the instrument regulated by the regulations shown in Table A.

However, for the test, the instrument is applied to the object until the object is in contact with the pressure surface, and the indicator is read.

Since the pressure needle of the instrument is protruded 2.54 mm from the pressure surface, if the object has an elasticity not less than the maximum elasticity of the test, the needle is pushed into the instrument completely by the object so that the indicator indicates 100°.

Otherwise, the indicator displays the hardness of the object according to the elasticity of the object with a number between 0° and 100°.

TABLE A

| | Needle size | | | |
|---|---|---|---|---|
| | Maximum | Figure of | Spring load | |
| Test | height | needle | AT 0° | AT 100° |
| Asker C | 2.54 mm | FIG. 10 | 55 g | 855 g |

As illustrated in the schematic illustration of FIG. 2 of the processing tank and the rack, and also as illustrated in the schematic illustration of FIG. 1 of the photosensitive material processing apparatus to which the processing tank and the rack are assembled, together with the guide member 8, these conveyance rollers 9 hold and convey the photosensitive material. In this case, the guide member 8 is made of high density polyethylene (HDPE) and the thickness is 1 mm.

An example of the photosensitive material processing apparatus having a processing tank into which the conveyance rollers of Examples 7, 8, 9 and 10 of the present invention are attached is briefly shown in FIG. 1 and FIG. 2.

Conveyance rollers according to each of the seventh, eighth, ninth and tenth examples and also conveyance roller according to each of Comparative Examples 1 and 2 were set in a conveyance rack. Then the conveyance rack was assembled to the photosensitive material processing apparatus shown in FIG. 1. By the photosensitive material processing apparatus, the photosensitive materials were processed, and the following items were evaluated.

Sheets of color photographic paper of type A-6 (glossy) manufactured by Konica Co. were used. In this case, the paper size was L (127×89 mm). The above sheets were conveyed in the photosensitive material processing apparatus.

Results of the test were evaluated by an average of 10 sheets of color paper. In this test, a processing agent kit of Color Paper Treatment Process CPK-2-28 manufactured by Konica Co. was used, and the conveyance speed was set at 2900 mm/min.

Items and of evaluation are described below, and the method of evaluation is also described below.

(1) Conveyance property (Skew)

Figure 42:
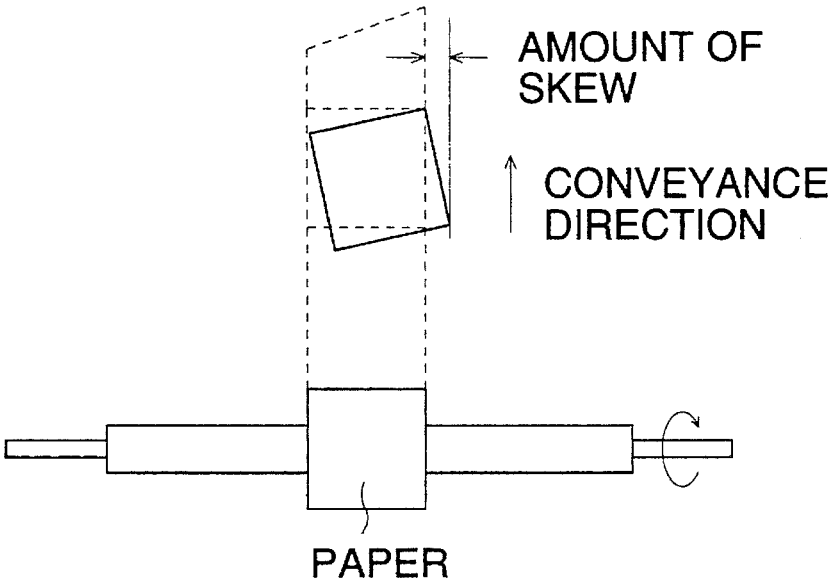
FIGS. 42(A) and 42(B) are schematic illustrations for explaining the skew and transverse dislocation of a sheet of paper.
Figure 42:
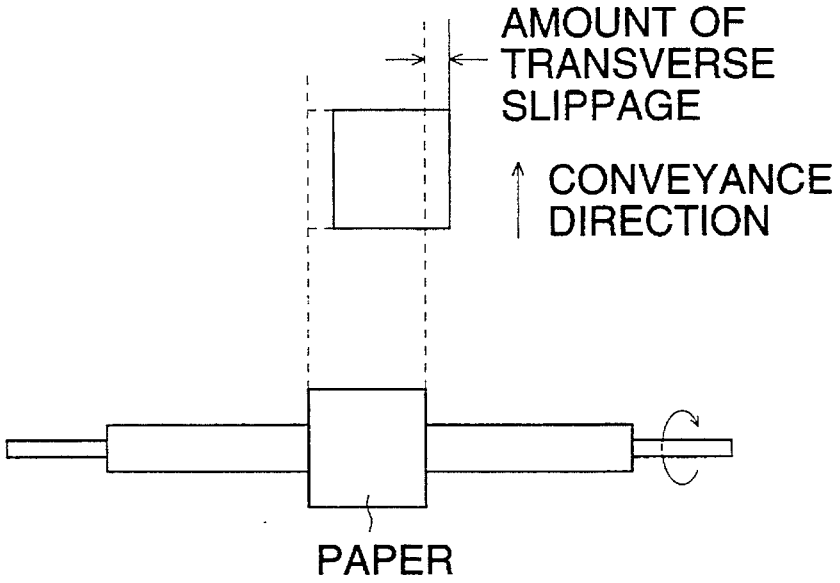

An amount of skew shown in FIG. 42(A) is defined as an amount of dislocation of a sheet of paper when the sheet of paper is conveyed in a skew condition with respect to the sheet conveyance direction. The amount of skew was measured at an outlet of the processing apparatus shown in FIG. 1.

| | |
|---|---|
| ⊙: Amount of dislocation | 0 to 2.0 mm |
| ○: Amount of dislocation | 2.0 to 5.0 mm |
| X: Amount of dislocation | More than 5.0 mm |

(2) Conveyance property (Amount of transverse slippage)

An amount of tranverse slippage in FIG. 42(B) is defined as an amount of dislocation of a sheet of paper when the sheet of paper is moved in parallel in a direction perpendicular to the sheet conveyance passage.

| | |
|---|---|
| ⊙: Amount of dislocation | 0 to 2.0 mm |
| ○: Amount of dislocation | 2.0 to 5.0 mm |
| X: Amount of dislocation | More than 5.0 mm |

(3) Contamination of a sheet end portion

A sheet of paper to be processed was removed form the processing rack at a specific position of the outlet of the third stabilization tank 15 of the processing apparatus shown in FIG. 1, and an amount of the processing solution that had soaked into the sheet end portion was measured. Dried sheets of paper to be processed were subjected to sampling inspection at an outlet of the drying process of the processing apparatus shown in FIG. 1, and discoloration at the sheet end portions was checked.

| | |
|---|---|
| ⊙: Amount of solution soaked into sheet end portion | 0 to 0.2 mm |
| ○: Amount of solution soaked into sheet end portion | 0.2 to 0.3 mm |
| X: Amount of solution soaked into sheet end portion | 0.3 to 0.5 mm |
| XX: Amount of solution soaked into sheet end portion | More than 0.5 mm |

Results of evaluation effected by the above evaluation method are shown in Table 1.

TABLE 1

| Type of conveyance roller | Conveyance property (Skew) | Conveyance property (Transverse slippage) | Contamination of sheet end portion: Amount of solution soaked into sheet end portion | Contamination of sheet end portion: Discoloration at sheet end portion |
|---|---|---|---|---|
| Example 7 | ○ | ⊙ | ⊙ | No discoloration |
| Example 8 | ⊙ | ⊙ | ○ | No discoloration |
| Example 9 | ○ | ○ | ⊙ | No discoloration |
| Example 10 | ○ | ⊙ | ⊙ | No discoloration |
| Comparative Example 1 | ⊙ | ⊙ | X | Discoloration |
| Comparative Example 2 | ⊙ | ⊙ | XX | Discoloration |

In this connection, the following conveyance rollers were made:

The inner structure of the conveyance rollers was the same as that of the conveyance roller of the eleventh example, and the hardness of the outermost circumferential layer was the same as the hardness described in the seventh, eighth, ninth and tenth examples. The thus prepared conveyance rollers were assembled to the above processing apparatus. Results of the test were as good as the seventh, eighth, ninth and tenth examples.

According to the present invention, it is possible to prevent the occurrence of slippage, skew and transverse dislocation in each processing tank in the photosensitive material processing apparatus. Further, it is possible to prevent the occurrence of contamination of end portions of a sheet of color paper. Under the above condition, sheets of color paper are stably conveyed at high speed. Therefore, the processing speed of photosensitive material is remarkably increased.

What is claimed is:

1. A photosensitive material processing apparatus for processing a photosensitive material with a processing solution, said apparatus comprising:

(a) a processing rack for forming a conveyance path for said photosensitive material in said processing solution;

(b) a conveyance roller for conveying said photosensitive material, wherein said conveyance roller is disposed in said processing rack, has a circumferential surface and is driven by a driving device;

(c) a guide member having a surface for slidably supporting said photosensitive material, wherein said guide member is disposed in said processing rack so that said surface faces said circumferential surface of said conveyance roller; and (d) a guide support member for supporting and engaging said guide member, wherein said guide support member is disposed to at least one of an upper portion and a bottom portion of said processing rack, wherein said photosensitive material is conveyed by said conveyance roller as said photosensitive material is nipped between said conveyance roller and said guide member.

2. The apparatus of claim 1, wherein said guide member is capable of being conveyed to a set position, where said guide member properly functions with said conveyance roller to convey said photosensitive material, by said conveyance roller and said guide support member; and said guide member is removed from said apparatus by said conveyance roller.

3. The apparatus of claim 1, wherein said guide member is conveyed to a set position, where said guide member properly functions with said conveyance roller to convey said photosensitive material, by rotating said conveyance roller in a conveyance direction of said photosensitive material; and said guide member is supported at one end by said guide support member.

4. The apparatus of claim 1, wherein said guide member is removed from said apparatus by rotating said conveyance roller in a reverse direction which is opposite direction to a conveyance direction of said photosensitive material.

5. The apparatus of claim 1, wherein said surface of said guide member has a recess portion extending along an axis direction of said conveyance roller; and the distance between said recess portion and said circumferential surface of said conveyance roller is between 0.1 and 2 mm.

6. The apparatus of claim 1, wherein said guide member is a sheet member having a thickness between 0.1 and 3 mm.

7. The apparatus of claim 1, wherein said guide member has a Vickers hardness between 2 and 10 kg/mm$^2$.

8. The apparatus of claim 1, wherein said surface of said guide member has a flatness not more than 1 mm.

9. The apparatus of claim 1, wherein said processing rack has a side panel; and said side panel and said guide member have a hole therein.

10. The apparatus of claim 1, further comprising:

a holding member for holding said guide member and for pressing said guide member onto said photosensitive material as being conveyed between said guide member and said conveyance roller;

wherein said processing rack includes an inner frame unit, in which said conveyance roller is accommodated, and an outer frame unit, in which said guide member and said holding member are accommodated; and said inner frame unit and said outer frame unit are detachably coupled with each other to form said processing rack.

11. The apparatus of claim 1, further comprising:

a holding member for holding said guide member and for pressing said-guide member onto said photosensitive material as being conveyed between said guide member and said conveyance roller;

wherein said processing rack includes an inner frame unit, in which said conveyance roller and said guide member are accommodated, and an outer frame unit, in which said holding member is accommodated; and said inner frame unit and said outer frame unit are detachably coupled with each other to form said processing rack.

12. The apparatus of claim 1, wherein said surface of said guide member has a beaded surface.

13. The apparatus of claim 12, wherein said beaded surface is provided only at portions on said surface other than a portion opposed to said circumferential surface of said conveyance roller.

14. The apparatus of claim 1, wherein said guide member retains a lubricant.

15. The apparatus of claim 1, wherein said circumferential surface of said conveyance roller is composed of at least one of a porous resin material and a porous rubber material; and said conveyance roller conveys said photosensitive material by having a contact with a photosensitive surface of said photosensitive material.

16. The apparatus of claim 1, wherein a center portion of said conveyance roller is composed of a barrel roller; and said conveyance roller has a multi-layer structure of said barrel roller and a circumferential surface portion which is made of at least one of a porous resin material and a porous rubber material.

17. The apparatus of claim 16, wherein said conveyance roller is composed of a porous plastic cylinder and said barrel roller which is press-fitted into said porous plastic cylinder.

18. The apparatus of claim 16, wherein said conveyance roller is composed of said barrel roller and at least one of said porous resin layer and said porous rubber layer in which at least one of said porous resin layer and said porous rubber layer is put on said barrel roller by thermal fusion so as to be solidified with said barrel roller.

19. The apparatus of claim 1, wherein said conveyance roller conveys said photosensitive material by having a contact with a photosensitive surface of said photosensitive material.

20. The apparatus of claim 1, wherein said circumferential surface is composed of a circumferential surface portion; and a hardness of said circumferential surface portion of said conveyance roller is not more than 60 in accordance with the SRIS 0101 standard.

21. The apparatus of claim 20, wherein a center portion of said conveyance roller is composed of a barrel roller; and said conveyance roller has a multi-layer structure of said barrel roller and at least one layer of said circumferential surface portion.

22. The apparatus of claim 21, wherein said barrel roller is made of a material, selected from polyolefines, polyphenylene sulfide, denatured polyphenylene oxide, phenol resin, vinyl chloride, stainless steel, and titanium.

23. The apparatus of claims 20, wherein an outermost layer of said circumferential surface portion is made of at least one of nonwoven fabrics and woven fabrics, selected from polyolefine fibers, polyester fibers, polyacrylonitrile fibers, aliphatic polyamide fibers, aromatic polyamide fibers, polyphenylene sulfide fiber.

24. The apparatus of claim 20, wherein an outermost layer of said circumferential surface portion is made of a mollten.

25. The apparatus of claim 24, wherein said mollten is polypropylene.

26. The apparatus of claim 24, wherein an end portion of said mollten is processed with thermal fusion.

27. The apparatus of claim 24, wherein a fabric loop formation surface of said mollten is arranged to be fixed to an outer surface of said barrel roller.

28. The apparatus of claim 20, wherein said conveyance roller conveys said photosensitive material by having a contact with a photosensitive surface of said photosensitive material.

29. The apparatus of claim 1, wherein said guide member is a flexible material and is fixedly disposed in a conveyance direction of said photosensitive material.

30. The apparatus of claim 1, further comprising a holding member for holding said guide member in contact with said conveyance roller.

31. The apparatus of claim 1, wherein said guide member is formed on one piece.

32. The apparatus of claim 1, wherein said circumferential surface of said conveyance roller comprises at least one of a porous resin material and a porous rubber material, wherein at least one of said porous resin material and said porous rubber material is made by either thermal fusion or sintering.

33. The apparatus of claim 32, wherein at least one of said porous resin material and said porous rubber material includes a composite material of polyethylene and polypropylene.

34. The apparatus of claim 32, wherein said porous resin material and said porous rubber material is selected from the group consisting of a plastic resin and a composite material comprising at least one of said porous resin and said porous rubber, wherein said plastic resin is selected from the group consisting of polyolefins, polyester, polyacrylonitriles, aliphatic polyamides, aromatic polyamides, polyphenylene sulfides, polytetrafluoroethylene, polyurethane, silicones and ethyleneproplenes.

35. A photosensitive processing apparatus for processing a photosensitive material with a processing solution, said apparatus comprising:

(a) a processing rack for forming a conveyance path of said photosensitive material in said processing solution;

(b) a conveyance roller for conveying said photosensitive material, wherein said conveyance roller is disposed in said processing rack, has a circumferential surface, a plurality of sides, and is driven by a driving device;

(c) a guide member having a surface for slidably supporting said photosensitive material, wherein said guide member is disposed in said processing rack so that said surface faces said circumferential surface of said conveyance roller at both sides of said conveyance roller and said circumferential surface is sandwiched therebetween; and (d) a guide support member for supporting and engaging said guide member, wherein said guide support member is disposed to at least one of an upper portion and a bottom portion of said processing rack, wherein said photosensitive material is conveyed by said conveyance roller as said photosensitive material is nipped between said conveyance roller and said guide member.

36. The apparatus of claim 35, wherein said guide member is formed in one piece.

37. A photosensitive material processing apparatus for processing a photosensitive material with a processing solution, said apparatus comprising:

a processing tank for holding said processing solution, the processing tank accommodating:

(a) a processing rack for forming a conveyance path of said photosensitive material in said processing solution;

(b) a plurality of conveyance rollers for conveying said photosensitive material, wherein each conveyance roller is disposed in said processing rack, has a circumferential surface and is driven by a driving device;

(c) a guide member having a surface for slidably supporting said photosensitive material, wherein said guide member is disposed in said processing rack so that said plurality of conveyance rollers are disposed only on one side of said guide member where said surface is provided; and (d) a guide support member for supporting and engaging said guide member, wherein said guide support member is disposed to at least one of an upper portion and a bottom portion of the processing rack, wherein said photosensitive material is conveyed by said plurality of conveyance rollers as said photosensitive material is nipped between said plurality of conveyance rollers and said guide member.

* * * * *